US007300333B1

(12) United States Patent
Kalanovic

(10) Patent No.: US 7,300,333 B1
(45) Date of Patent: Nov. 27, 2007

(54) CONTROL SYSTEM AND METHOD FOR PROCESSING JEWELRY AND THE LIKE

(75) Inventor: Vojislav Kalanovic, Rapid City, SD (US)

(73) Assignee: Control Systems Technologies, LLC, Rapid City, SD (US)

( * ) Notice: Subject to any disclaimer, the term of this patent is extended or adjusted under 35 U.S.C. 154(b) by 0 days.

(21) Appl. No.: 11/809,057

(22) Filed: May 30, 2007

Related U.S. Application Data

(62) Division of application No. 11/088,476, filed on Mar. 23, 2005, now Pat. No. 7,241,200.

(51) Int. Cl.
*B24B 49/00* (2006.01)

(52) U.S. Cl. ..... 451/5; 451/9; 451/10; 451/11; 125/30.01

(58) Field of Classification Search ..... 451/5, 451/9, 10, 11, 41, 57; 125/30.01; 414/806, 414/222.03, 222.04, 222.05, 222.12
See application file for complete search history.

(56) References Cited

U.S. PATENT DOCUMENTS

| | | | | |
|---|---|---|---|---|
| 3,992,822 | A * | 11/1976 | Faubel et al. | 451/401 |
| 5,917,300 | A | 6/1999 | Tanquary et al. | |
| 6,357,994 | B1 * | 3/2002 | St. Onge | 414/738 |
| 6,711,804 | B2 * | 3/2004 | Eicher | 29/563 |
| 6,752,691 | B1 * | 6/2004 | Jakoby et al. | 451/6 |
| 7,086,518 | B1 * | 8/2006 | Hranica et al. | 198/341.03 |
| 2006/0213048 | A1 * | 9/2006 | Kalanovic | 29/468 |
| 2007/0009395 | A1 * | 1/2007 | Jiang | 422/104 |

OTHER PUBLICATIONS

Polishing Robot PR/RX60, Buko Precision Machines, Exact date unknown, http://www.buysschaert.com/buko_machines_htm/PR%20RX%2060/PR%20RX%2060%20Engels.htm.
Modular "Balanced" Gantry Robot Systems, Composite Systems, Inc., 2004, Website: http://www.compositemfg.com/GantryRobots.htm.
R-100 Ring Grinding and Polishing Systems, Superior Robotics, Inc., 2004, http://www.superiorrobotics.com/images/SR-R100_System.doc.
United Robotic Integrations, LLC, URI R-100 Interface Software, Apr. 2002, http://www.unitedrobotic.com/R-100software.htm.
United Robotic Integrations, LLC, R-110 Ring Finishing System, Apr. 2002, http://www.unitedrobotic.com/r100.htm.

* cited by examiner

*Primary Examiner*—Eileen P. Morgan
(74) *Attorney, Agent, or Firm*—Gordon & Rees, LLP

(57) ABSTRACT

A control system for controlling processing of workpieces such as jewelry has gantry and gimbal units having x, y, z translational and x, y, z rotational degrees of freedom, the units carrying a gripper for holding a piece of jewelry. Drive motors are associated with each translational and rotational degree of freedom and an actuator operates the gripper. A controller is linked to the gantry and gimbal unit motors, the gripper unit actuator, and actuators associated with a series of work stations for carrying out processing operations such as lapping and grinding. The controller controls movement of the gripper unit from a start position to pick up a workpiece and move it along a programmed path between the processing stations, and controls operation of actuators at each processing station to process workpieces according to stored program instructions. A user input device provides optional operator control of the movement and processing for system training purposes.

18 Claims, 29 Drawing Sheets

Automatic grinding (SEQUENCES EXAMPLE)

Automatic grinding (SEQUENCES EXAMPLE)

Automatic polishing (SEQUENCES EXAMPLE)

Automatic polishing (SEQUENCES EXAPLME)

CONTROL SYSTEM AND METHOD FOR PROCESSING JEWELRY AND THE LIKE

BACKGROUND OF THE INVENTION

The present invention relates generally to control systems and methods for automated processing of parts such as jewelry and the like through a series of work stations, and is particularly concerned with a control system and method for an automated processing apparatus carrying out a material removal process.

Since the jewelry industry evolved into a manufacturing industry rather than a simple hand crafting industry, there has been a need for an automatic method and apparatus for grinding, polishing and repair of jewelry, as well as for initial creation of jewelry without casting. Some of these tasks are still typically carried out by hand, and jewelry making is still a very labor intensive process. For a typical jewelry manufacturer, the initial creation of a jewelry piece is carried out by casting. This involves creating a master model out of steel, creation of wax copies of the master, and then using an investment casting process to create a final jewelry piece out of precious metal alloy. This process creates sprues and requires coarse grinding as well as fine grinding and polishing in order to finish the piece. In this process, over 60% of the labor time is dedicated to finishing the piece of jewelry. These tasks are typically carried out by hand, with each individual piece of jewelry handled separately. The task of grinding and/or polishing of jewelry typically consists of holding a piece of jewelry against a turning grinding wheel. Such a process is monotonous, and also can present a health hazard due to the dust created during the procedure.

The existing jewelry manufacturing processes are time-consuming and labor intensive. In some areas, the quality of the jewelry piece is strongly dependent on the operator. There is therefore a need for automation of at least part of the jewelry manufacturing process in order to produce a more economical, consistent and predictable product with potential savings in precious metal.

Robotic commercial systems have been used in the past to perform some jewelry finishing processes, but typically only in finishing of rings. Such robotic systems, for example the Ring Grinding and Polishing System of Superior Robotics, Inc. of Ontario, Canada, can perform the steps of sprue removal from a ring, grinding the shank on the outside of the ring, pre-polishing the outside of the ring, grinding the inside of the ring, and pre-polishing the inside of the ring. However, this system cannot handle any other types of jewelry and can perform only these limited operations. The robotic control system has distributed software, with part working on the robot's controller and the other part on a separate computer or PC. This means that the software is not readily adaptable to different hardware components. There is therefore a need for an improved automated apparatus for jewelry processing, and for a control system and method for controlling operation of such an apparatus.

SUMMARY OF THE INVENTION

It is an object of the present invention to provide a new and improved control system and method for a processing apparatus for processing of parts to perform operations such as material removal, polishing, welding, or the like.

According to one aspect of the present invention, a control system for controlling operation of a processing machine is provided, which comprises a computer programmed with a plurality of program modules for controlling different operations of the machine, a data base for storing piece parameters and styles, program instructions, and machine parameters, an output monitor connected to the computer for displaying data and application windows associated with each machine procedure, and a joystick input device for use by an operator in training the system, the program modules comprising a monitoring module for displaying data on the output monitor, a manual module for manual control of motor movements, set up of parameters, and training of the system, and an auto module for controlling an automatic production process based on instructions stored in the training procedure.

The program modules may further comprise a data base module for updating and organizing data, and a setup module for set up of basic parameters for the system hardware and software. In an exemplary embodiment, the software controls the display on the output monitor to provide a continuous update of various system parameters. The software may be linked to a remote controller for external monitoring of the system operation, allowing a remote site diagnostic to be made.

The software in an exemplary embodiment of the invention includes software drivers for various motors or actuators used in moving workpieces between different work stations and in operating tools at the work stations. A graphical interface may be used for user input to the system, allowing the user to structure a motion of a workpiece as well as to assign specific system commands.

In an exemplary embodiment of the invention, the manual training module comprises means for training operation of a gantry unit having x, y and z translational degrees of freedom and means for training operation of a gimbal unit mounted on the gantry unit and having x, y and z rotational degrees of freedom, the means for training the gantry unit comprising means for associating right and left movements of the joystick with operation of a gantry x-axis motor to move a gantry x-axis carriage in corresponding directions, means for associating up and down movements of the joystick with operation of a gantry y-axis motor to move a gantry y axis carriage in opposite directions, and means for associating actuation of respective buttons on the joystick with operation of a gantry z-axis motor to move a gantry z-axis carriage in opposite directions, and the means for training the gimbal unit comprising means for associating right and left movements of the joystick with operation of a first gimbal motor to rotate in opposite directions, means for associating up and down movements of the joystick with operation of a second gimbal motor to rotate in opposite directions, and means for associating actuation of respective buttons on the joystick with operation of a third gimbal motor to rotate in opposite directions, whereby the system can be trained to move a gripper unit attached to the gimbal unit along a predetermined path with predetermined end points along the path at successive processing stations in the machine.

The joystick based trajectory planner allows the user to readily teach the system desired gantry paths and gimbal paths without requiring any separate control devices hooked to the gantry or gimbal units.

The manual training module may also comprise means for user entry and storing of machine parameters. In the case of a jewelry processing application, these parameters may be gripper force, grind force, polishing force, lapping force, and the speed of the various motors. In an exemplary embodiment of the invention, the manual module further comprises an on-off commands block and a movement command block. The on-off commands block comprises means for user control of operation of a main gripper unit for carrying a piece between a series of processing stations and operation of a flip gripper unit for allowing the grip position of a piece in the main gripper unit to be changed. The movement commands block may comprise means for user entry of commands for moving the gantry and gimbal units to a start position, moving the gripper unit to a pick position above a tray, moving the gantry and gimbal units successively to the work stations where different procedures are carried out, and initiating two different procedures at the two workstations when the work piece is positioned properly at the respective workstations.

This system may be used for control of processing machines for use in various different applications, such as material removal and part shaping, polishing of parts, welding, glue dispensing, laser jet cutting, assembly, palletizing, laser deposition, pick/place, and friction steer welding.

In an exemplary embodiment of the invention, the control system is adapted for use in jewelry processing (grinding and polishing). Where the jewelry to be processed comprises rings, the auto module comprises means for user entry of the style and size of each ring to be processed and the position of each ring on a storage tray. The module includes means for copying a style and size previously entered to additional positions on the storage tray. The auto module further comprises means for user entry of a start command when ring style and size for each tray position has been entered. The ring style and size input includes an empty designation for a tray location carrying no ring.

In an exemplary embodiment of the invention, the system software includes a lapping procedure comprising means for controlling the main gripper unit to hold a ring in a vertical orientation to present a first side face of the ring for lapping, means for controlling the gantry motors to drive the gripper unit and ring to a lapping wheel, means for controlling the drive of the lapping wheel to perform a lapping operation in which sprue is removed from the first side face of the ring, means for detecting when all sprue is removed from the first side face, means for flipping the ring by 180 degrees to be gripped in an opposite vertical orientation to present a second side face of the ring to the lapping wheel, means for moving the gripper unit and ring up to the lapping wheel, and means for controlling the lapping wheel to perform a second lapping operation in which sprue is removed from the second side face of the ring.

The lapping procedure includes means for ensuring that the gripper fingers are level with the outer side face of the vertically oriented ring in the lapping process. The lapping procedure in the exemplary embodiment further comprises means for driving the gantry and gimbal units to move a gripper unit carrying a ring from a start position to a flip station, means for positioning the ring within reach of a flip gripper and actuating the gripper to grip the ring, means for actuating the main gripper unit to release the ring, means for driving the gantry to move the main gripper unit away from the flip gripper, means for controlling the flip gripper unit motor to re-position the ring in a vertical orientation, means for controlling the gantry and gimbal units to move the main gripper unit back to the flip gripper in a horizontal orientation to grip the vertically oriented ring, means for controlling the flip gripper to release the ring, and means for controlling the gantry unit to move the main gripper unit and ring back to the start position.

The software may also include means for keeping track of the average precious metal consumption or removal, and for displaying this information as a production parameter on the output monitor. For a particular style of ring, the same amount of material is removed, on average, for each ring processed. This value is stored in the data base for each ring style, and the computer is programmed to keep track of how many rings of each style have been processed at any point, and the average total amount of material which has been removed as a result of this processing. This allows the user to optimize the material removal process.

The entire software system may be based on an OPC (object linking and embedding for process control) client/server structure, which allows various existing and independent protocols and/or software units to be seamlessly interfaced, added or subtracted. This allows hardware changes, driver changes, and software module changes to be made easily without affecting other components of the system. Existing OPC client/server structures allow any standard software product such as Microsoft Word, Excel, Access, or the like to be added as a client. Thus, the user can monitor or modify any system parameter in real time through tools that are normally used for other applications.

According to another aspect of the present invention, a method of controlling a processing machine to process a plurality of workpieces is provided, in which the processing machine has a gantry unit for x, y and z translational positioning of a workpiece, a gimbal unit mounted on the gantry unit for x, y and z rotational positioning of the workpiece, a main gripper unit for holding the workpiece, and a plurality of spaced work stations for manipulating or processing the workpiece, the method comprising the following steps:

setting up at least one desired trajectory of a workpiece from a storage tray through a selected series of end positions at work stations and then back to an end position, the trajectory being associated with a selected workpiece style;

setting up a series of parameters for processing the workpiece;

setting up a series of workpiece locations on a storage tray;

controlling the gantry and gimbal motors to move the main gripper unit to a first position over a workpiece on the storage tray;

controlling the gantry motors and gripper unit to move to the workpiece, grip the workpiece, and move the workpiece from the tray;

controlling the gantry and gimbal motors to move the workpiece along the desired trajectory and stop at each end position;

at each end position, controlling the tool at the workstation and the gantry and gimbal motors to carry out a processing operation at the workstation before continuing to move the workpiece along the desired trajectory to the next workstation;

after the workpiece has been processed at the last work station in the series, moving the workpiece back to the end position;

controlling the gripper unit to release the workpiece;

controlling the gantry, gimbal and gripper units to move to the next workpiece position on the tray and to pick up the next workpiece to be processed; and repeating the procedure until all workpieces on a tray have been processed.

The end position may be the same as the original position of the workpiece on the storage tray.

In an exemplary embodiment of the invention, the machine is for processing jewelry such as rings or other jewelry pieces, and the workstations may be grinding wheels and/or polishing wheels. The workstations may include a lapping wheel and the method may include a lapping operation in which the workpiece is held in a desired orientation for lapping. In an exemplary embodiment of the invention, at least one workstation is a grinding station having grinding wheels and a lapping wheel, and the wheel is mounted on a movable tool bed, with a force controller for controlling force applied to the wheel. The method in this case further comprises means for moving the workpiece to a position at which a selected surface would first contact the processing wheel if there were no sprues projecting outwardly from the surface, whereby any projecting sprue will displace the wheel from its zero position, detecting displacement of the wheel by a change in a sensor condition, and operating the processing wheel to perform a lapping or grinding operation until the wheel moves back to the zero position.

In an exemplary embodiment of the invention, the method may further comprise a training process in which an operator controls the gantry, gimbal and gripper units using a manual input device such as a mouse or joystick so as to move a first workpiece of a particular style along a predetermined trajectory through the machine, and provides input of each end point along the trajectory, the method including storing training data associated with each style of workpiece trained on the system, the training data comprising the trajectory and end points, processing parameters associated with each end point, and associating style information for the workpiece with the stored training data.

The control system and method of this invention is user friendly and allows an entire grinding and/or polishing procedure for a piece of jewelry or other workpiece to be customized and then repeated reliably for all pieces of jewelry of the same size and style. The system can run automatically for extended periods of time while operators can monitor operating parameters as needed, and may be programmed to interrupt processing if an error is detected. The system allows an entire part processing operation to be performed automatically, and allows for training for different style and piece sizes to expand the system capabilities. Stored processing data is portable from one machine to another so that a training process can be performed on one machine and the process can actually be carried out on a different machine. The entire control system runs on a single computer, such as an industrial PC, and is not based on a specific hardware. The system can incorporate different components from different manufacturers with ease.

BRIEF DESCRIPTION OF THE DRAWINGS

The present invention will be better understood from the following detailed description of an exemplary embodiment of the invention, taken in conjunction with the accompanying drawings, in which like reference numerals refer to like parts, and in which.

DETAILED DESCRIPTION OF THE DRAWINGS

Figure 1:
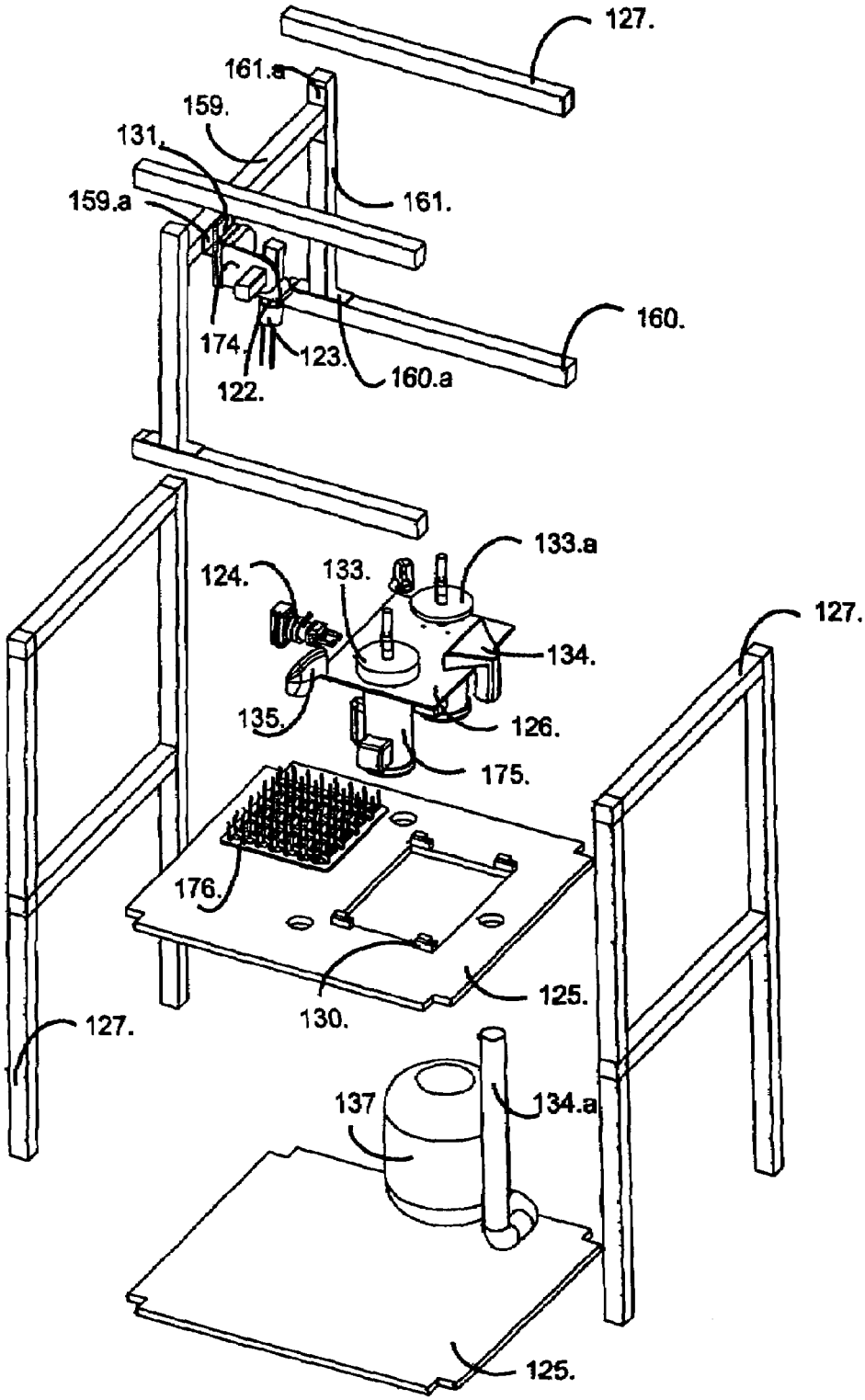
FIG. 1 is an exploded perspective view of the components of a jewelry processing apparatus.

FIGS. 2 to 22 of the drawings illustrate a software control system and method according to an exemplary embodiment of the invention for controlling operation of a jewelry processing apparatus, such as the apparatus illustrated in FIG. 1. This apparatus is described in more detail in my co-pending application entitled Positioning Apparatus and Method Incorporating Modular Gimbal Unit, and Jewelry Processing System incorporating the Apparatus, which is being filed on even date herewith, and the contents of that application are incorporated herein by reference. Although the illustrated embodiment is adapted for processing jewelry such as rings, it will be understood that the control system and method of this invention may be used in an equivalent manner for processing other metal parts and may be adapted for different processing applications such as welding, other material removal applications, glue dispensing, laser jet cutting, assembly, palletizing, laser deposition, pick/place and friction steer welding.

The apparatus as illustrated in FIG. 1 basically comprises a horizontal work plate 125 mounted on an outer frame with a gantry assembly mounted above the work plate for movement in x, y and z linear directions, and a gimbal unit 174 having three rotary joints mounted on the gantry assembly for rotation in perpendicular pitch, roll and yaw directions about the three perpendicular rotary joints. A gripper unit

123 for holding a part to be processed is mounted on the end of the gimbal unit. Various work stations are mounted on the work plate 125, along with one or more trays 176 for holding parts prior to or after processing stages. A tool bed 126 is slidably mounted over an opening in the table for sliding movement on rails 130 provided along opposite edges of the opening. A slider drive cylinder 127 (see FIG. 2) controls the amount of force applied to the sliding tool bed, and thus the application force of a tool on the tool bed against a part. FIG. 1 illustrates three work stations on the work table, specifically first and second grinding wheels 133, 133*a* on tool bed 126, driven by motors 175 and 175*a*, and a flip station 124. However, additional work stations may also be provided and the grinding wheels may be replaced by polishing wheels, as described in my co-pending application referred to above.

A precious metal dust collection system is provided for collecting metal dust produced during processing. This comprises air blowers 135 and air collecting duct 134, 134*a* for blowing air across the work stations and collecting air and metal dust, and a filter unit 137 for removing collected metal dust from the air. Filter unit 137 is mounted on a base plate 125 of the gantry apparatus.

The frame 127 has a pair of horizontal side rails 160 defining a y axis or direction on opposite sides of the work plate. A pair of vertical rails 161 are slidably mounted at their lower ends on the side rails 160 via sliders 160*a*, and define a z-axis or direction. A horizontal rail 159 is slidably mounted on the vertical rails 161 at its opposite ends via sliders 161*a*, and defines an x-axis or direction. A slider 159*a* is slidably mounted on the horizontal, x-axis rail 159 for movement in the x-direction. Linear movement of each slider along the respective x, y and z-direction rails is controlled by a respective linear motor 118, 119 and 120 (see FIG. 2) as will be described in more detail below.

Movement of slider 159*a* along rail 159 provides adjustment in the x direction. Movement of the rail 159 up and down on the vertical rails 161 adjusts the location of slider 159*a* in the z-direction, while movement of the rails 161 along the side rails 160 adjusts the location of slider 160*a* in the y-direction.

The gimbal or three degree of freedom (3 DOF) rotary unit is mounted on slider or x-axis carriage 159*a* via bolts or the like extending through mounting holes on carrier plate 131. The gripper unit 123 is mounted on an interface or mounting plate of the gimbal unit 174 via a rotary union 122. The gripper unit 123 is designed to hold a piece of jewelry or any work piece to be processed. The gimbal unit has three drive motors, specifically an x or pitch motor 209, a y or yaw motor 210, and a z or roll motor 211 (see FIG. 2) for controlling rotation about the three perpendicular gimbal axes. Sensors 223 are provided for detecting the zero or start position of the x and y motors of the gimbal unit, while software associated with motor drives is used to detect the zero or start position of the z motor of the gimbal unit. In the start position, the three drive motor axles or rotation axes are oriented perpendicular to one another.

The basic operation of the system when the apparatus is set up for a grinding operation will first be described. This description assumes that the workpieces are rings, but it will be understood that the process will be similar for workpieces in the form of other types of jewelry or other articles having surfaces requiring grinding or material removal. The computer will have an input for an operator to initially enter parameters of the jewelry or other items to be processed, such as size and style. The operator may also enter ring or workpiece processing parameters, such as grinding force and motor speed, and travel paths for the workpiece. This may be done by first manually operating the system to process one workpiece, and training the system to process all remaining workpieces according to the same parameters. Alternatively each tray of workpieces may be associated with a bar code which identifies software instructions for operating the system in order to process the workpieces on the tray to desired specifications. In this case, the operator will simply scan the barcode before inserting the tray into the housing.

The gantry motors are then controlled to move the gimbal unit until the gripper unit is located above a first ring on tray 176. The gripper unit is then lowered until the three fingers of the gripper unit are located inside the ring, and the gripper is actuated to move the fingers outwardly to grip the inner surface of the ring. The gantry motors are then operated to lift the ring from its holder 205, and transport it to the first work station or sprue removal wheel 133. The gimbal unit motors will be operated to manipulate the ring in space during the grinding process as required, so that different portions are held against the grinding wheel 133, while the grinding wheel motor and the tool bed slide controller are activated so as to rotate the wheel at a selected speed and to apply a desired grinding force against the workpiece.

Once sprue removal is complete, the gimbal unit and gantry unit are controlled to move the ring to the next grinding wheel 133*a* and to orient the ring properly for contact with the wheel. The first grinding wheel is turned off and the second grinding wheel is activated at the desired grinding force and speed. The second grinding wheel 133*a* will be a contour grinding wheel for controlling the contour of the outer surface of the wheel. Again, the gimbal unit motors will be controlled in order to present different regions of the ring outer surface to the grinding wheel and grind the ring to the selected contour. Different grinding wheels may be mounted co-axially with grinding wheels 133, 133*a* on the same motor axles, as will be described in more detail below.

When all grinding operations for the outer surface of the ring are complete, the gantry and gimbal unit motors will be controlled in order to move the ring to the flip station. The flip station will be actuated in order to grip the ring on the outside, and the gripper unit will be actuated in order to release the ring. The gripper unit is then moved away from the flip station, and back in to grip the ring on the outside. The flip, station grip fingers are then released, and the gantry motors are controlled to move the ring back to the first or sprue removal wheel, so that the inside surface of the ring can be machined on the smaller grind wheel. The grinding steps are then repeated in order to grind the inner surface of the ring to the desired contour.

The grinding apparatus can also be used for a lapping operation in which the sprue is ground off from the opposite side edges of the ring. With the ring gripped appropriately by the gripper fingers, and the gimbal unit controlled to hold the ring vertically, a first side edge of the ring will be held against grinding wheel 133 to remove sprue from that side edge. The ring is then moved to the flip station and reversed so that the opposite side edge can be held against the grinding wheel for sprue removal or lapping.

Once the inner and outer surfaces and side edges of the ring have been appropriately finished, the ring will be returned to the storage tray 176 or to another storage tray for holding partially processed workpieces.

The grinding procedure will be carried out for all rings on the first tray 176. If a larger capacity is desired, the apparatus dimensions may be increased to include additional holding trays for unprocessed workpieces. This can permit a so-called "lights-out" or overnight operating mode.

When all the unprocessed workpieces have undergone the programmed grinding operation, the apparatus may be reconfigured for the polishing operation. This is done by removing the grinding wheels and replacing them with polishing wheels having rouge applicators. The gantry unit is then controlled to move the gripper unit to the tray and to pick up the first partially processed ring in the same manner as before. As with the grinding wheels, the polishing wheels are driven by motors 175 and 175*a* at a variable speed, and the polishing force applied will be controlled by the cylinder actuator for the tool bed slider. The tool bed has an integral position sensor for detecting when the workpiece comes into contact with the polishing wheel. In performing a polishing operation, the controller also moves the rouge applicator into contact with the polishing wheel and controls the amount of rouge applied.

Once the first stage polishing is complete, the gantry and gimbal units are controlled to move the workpiece to the second polishing wheel, and the second polishing wheel and associated rouge applicator are actuated to carry out the programmed polishing operation. After polishing of a first surface of the workpiece is complete (for example the outer surface of a ring), the workpiece is moved to the re-gripping or flip station, and the grip is changed so that a different surface can be polished, such as the inside of the ring. After polishing of the basic surfaces is complete, the gantry system may take the workpiece or ring to an optional crown polishing station. After all polishing is complete, the gantry system may be controlled to transport the workpiece to a separate cleaning and drying station. When polishing and cleaning is complete, the gantry and gripper units are controlled to transport the ring to a soft tray on which it can be dropped. The next workpiece can then be picked up for polishing.

Figure 2:
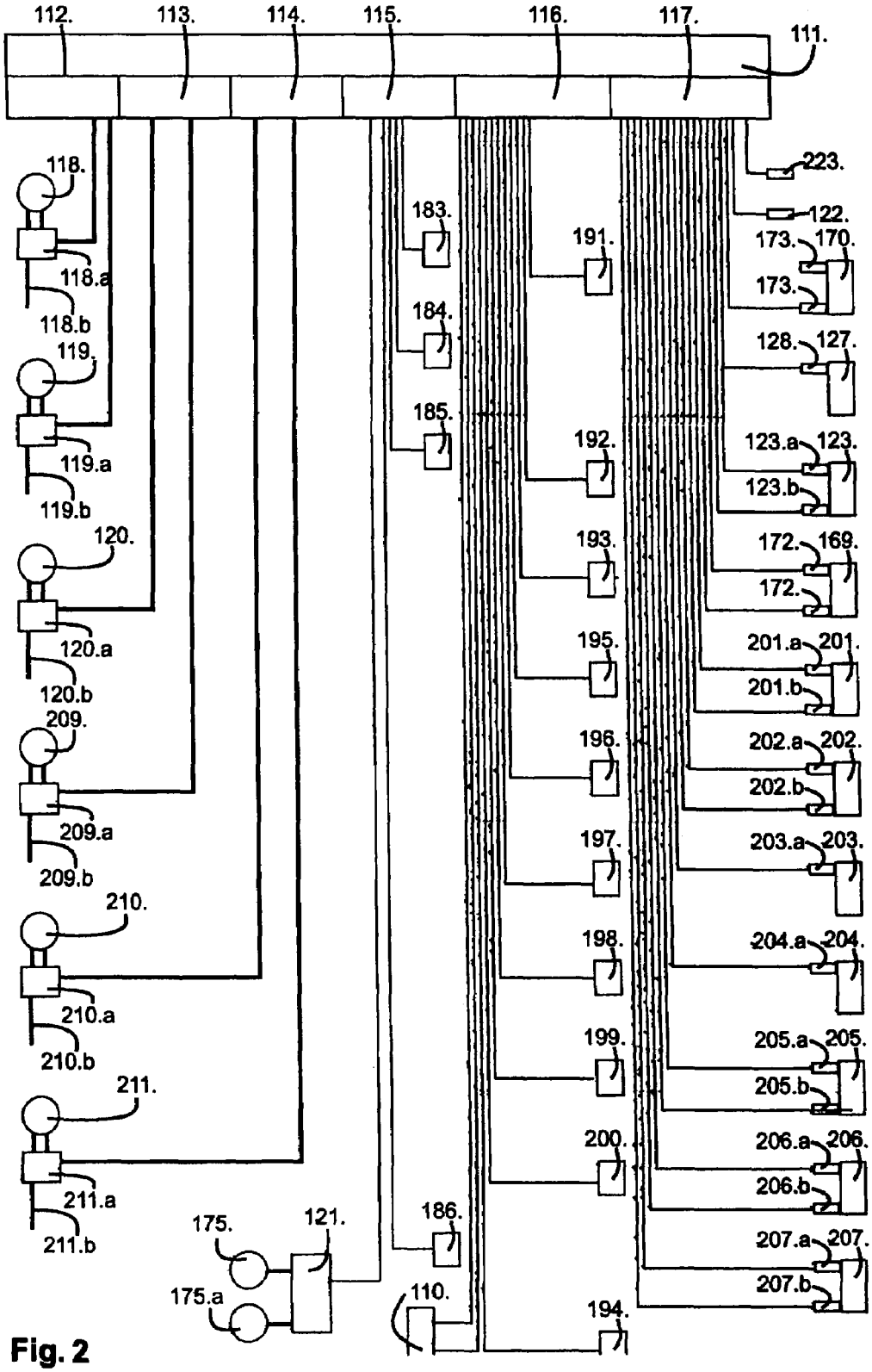
FIG. 2 is a schematic illustration of an electronic control system according to an exemplary embodiment of the invention for controlling operation of the apparatus of FIG. 1.
Figure 3:
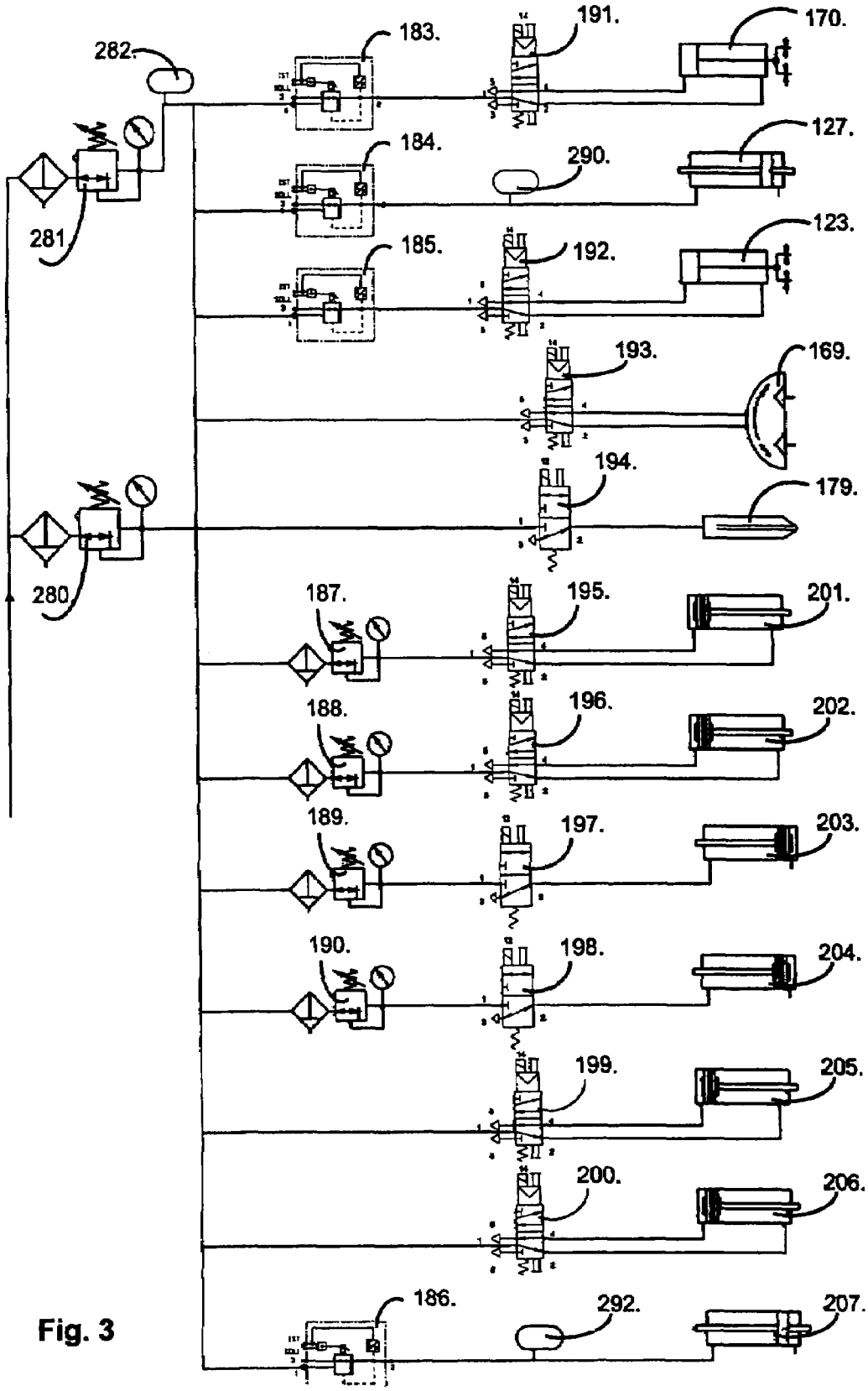
FIG. 3 is a schematic illustration of a pneumatic control system for various pneumatic slide cylinders for controlling movement of various parts of the apparatus of FIG. 1.

FIG. 2 is a schematic diagram of an electronic control system and FIG. 3 is a schematic diagram of the pneumatic control system for controlling the apparatus of FIG. 1 to perform the operations described above, while FIGS. 4 to 22 provide details of the software modules used to control the operation of the various components of the system.

The pneumatic control system of FIG. 3 controls various pneumatic actuators for moving various parts of the apparatus under the control of controller 111. The pneumatic actuator cylinders are illustrated on the right hand side of FIG. 3 and comprise a two finger gripper actuator 170 for the flip station, the pneumatic cylinder 127 for moving the tool bed 126, the pneumatic actuator 123 for the three finger gripper of the gripper unit, a pneumatic rotary cylinder 169 of the flip station, a cooling nozzle 179, the pneumatic cylinder actuators 201 to 206 for each of the rouge applicators at each polishing station as well as the crown polishing station, and the crown polishing tool position cylinder 207. The cooling nozzle 179 may be mounted on the y motor carrier or pitch plate 131 for directing a cooling air flow onto a ring or other workpiece carried by the gripper unit. This nozzle may be the end of a pneumatic pipe which is set along the electrical cable carriers of the gantry apparatus and then fixed to the interface or pitch plate 131.

Each rouge applicator cylinder is associated with two end position sensors (201*a*, 201*b*, 202*a*, 202*b*, . . . etc.) which indicate when the cylinder is in its fully retracted position and in its fully extended position. These sensors can be seen in the electronic control diagram of FIG. 2.

A pneumatic or pressurized air supply cylinder 182 is controlled by an input pressure regulator 180 and control pressure regulator 181. This arrangement is used to stabilize any air pressure oscillations and provide a unit work pressure of 0.6 MPa. Air supply to the actuator 170 is via a flip gripper input transducer 183 and solenoid valve 191. A force controller pressure tank 290 is connected to the force controller or slide cylinder 127 and the main air supply is also connected to cylinder 127 via pressure transducer 184. Transducer 184 is used to achieve the right force on the grinding wheel during grinding (or the polishing wheel during polishing). During grinding, the ring or other workpiece is pushed against the grinding wheel, and the force applied by the force controller or slide cylinder 127 will push back against the ring. The force selected depends on the grinding parameters of the jewelry and may be adjusted by the operator or under control of the software. As grinding takes place, the grinding wheel will follow the contour of the workpiece, also moving the sliding tool bed and actuator 127. At certain points during this movement, the actuator will need a fast replenishment of air, and also tends to cause pressure oscillations. The auxiliary pressure tank 290 takes care of both of these supply needs and eliminates any pressure disturbances in the system.

The gripper actuator 123 is connected to the air supply tank via transducer 185 and solenoid valve 192. Solenoid valve 193 controls air supply to the pneumatic rotary cylinder 169 of the flip station, while solenoid valve 194 controls air supply to the cooling nozzle 179. Each of the four rouge applicator cylinders 201, 202, 203 and 204 is connected to the pressurized air supply via a pressure regulator 187, 188, 189, and 190, respectively, and a solenoid valve 195, 196, 197 and 198, respectively. Rouge applicator cylinders 205, 206 are connected to the pressurized fluid supply via solenoid valves 199, 200, respectively. Finally, the positioning cylinder or force controller 207 for the crown polishing tool is connected to a crown polishing pressure tank 292, which operates in the same manner as the auxiliary pressure tank 290 of the sliding tool bed force controller or actuator 127, and is also connected to the pressurized fluid supply from tank 182 via pressure transducer 186 in order to vary the application force of the crown polishing tool.

The automatic operation is controlled by an industrial controller which is programmed by the operator to carry out specific functions. Although an industrial controller is used in the exemplary embodiment, a PC or PLC may be used in alternative embodiments. The advantage of an industrial controller is that it is a dedicated machine that includes all the I/O elements necessary for a particular application. A motor input/output card 112 connects x and y gantry motors 118, 119 and motor drives 118*a*, 119*a*, respectively (which may be Aries servo drives manufactured by Parker, such as the SM160 servo drive) to the computer. The x gantry motor 118 will drive the gantry x axis carriage 159*a* along the gantry member 159 defining the x-axis. The y gantry motor 119 will drive the y axis carriages or sliders 160*a* along side rails 160 defining the y axis. Each motor drive is connected to a power supply at input 118*b*, 119*b*, respectively The second motor input/output card 113 of computer 111 is connected to the z gantry motor 120 and motor drive 120*a* connected to power supply at input 120*b*, and to the x rotary motor 209 of the gimbal unit 174 via motor drive 209*a* connected to a power supply at input 209*b*. Motor drive 120*a* may also be an Aries servo drive or similar. Actuation of the z gantry motor will control driving of the z axis carriages or sliders 161*a* (FIG. 1) along the vertical or z-axis gantry members 161. Actuation of x rotary motor 209 will control rotation of a roll plate of the gimbal unit.

The third motor input/output card 114 of computer 111 is connected to the other two motors of the gimbal unit, specifically the y and z gimbal rotary motors 210 and 211. Motor 210 is controlled via drive 210*a* and connected to a power supply at input 210*b*, while motor 211 is controlled via drive 211*a* and connected to a power supply at input 211*b*.

It will be recognized that control of the various motors for driving the gantry sliders and the gimbal plates will control the position and orientation of the gripper unit 123, and thus the position and orientation of any workpiece held by the gripper fingers.

Analog output card 115 of the computer 111 is connected to the input transducers 183, 184, 185 and 186 of the gripper of flip station 124, force controller for the sliding tool bed 126, the three finger gripper of the gripper unit 123, and the crown force controller 207 (FIG. 3) of the crown polishing station, respectively. Card 115 is also connected to a frequency motor regulator 121 for the grind motors 175 and 175*a* which drive the grind wheels 133, 133*a*, respectively, or the polishing wheels when the apparatus is in a polishing configuration.

A digital output card 116 is connected to a series of solenoid valves 191 to 200 of the pneumatic control system of FIG. 3. These are the solenoid valve 191 for controlling the gripper of flip station 124, solenoid valve 192 for controlling the pneumatic cylinder actuator 170 for the gripper of gripper unit 123, solenoid valve 193 for controlling the flip station motor 169, solenoid valve 194 for controlling a cooling nozzle 179 which may be mounted on the gimbal unit 174, various rouge applicator solenoid valves 195 to 198 for controlling the pneumatic cylinder applicators 201 to 204 for rouge application at the polishing stations, and solenoid valves 199, 200 for controlling rouge applicator position cylinders 205 and 206. Card 116 is also connected to an alarm light 110. A digital input card 117 receives inputs from all of the sensors in the system The sensors comprise the gimbal unit zero position sensors 222, 223, gripper sensors 173 of the flip station gripper, the force controller sensor 128 of the tool bed drive cylinder or force controller 127, the three finger gripper sensors 123*a* and 123*b* of the gripper unit 123, the flip station motor sensors 172, the rouge applicator sensors 201*a*, 201*b* to 206*a*, 206*b*, and the crown polishing tool position sensors 207*a* and 207*b*.

Figure 4:
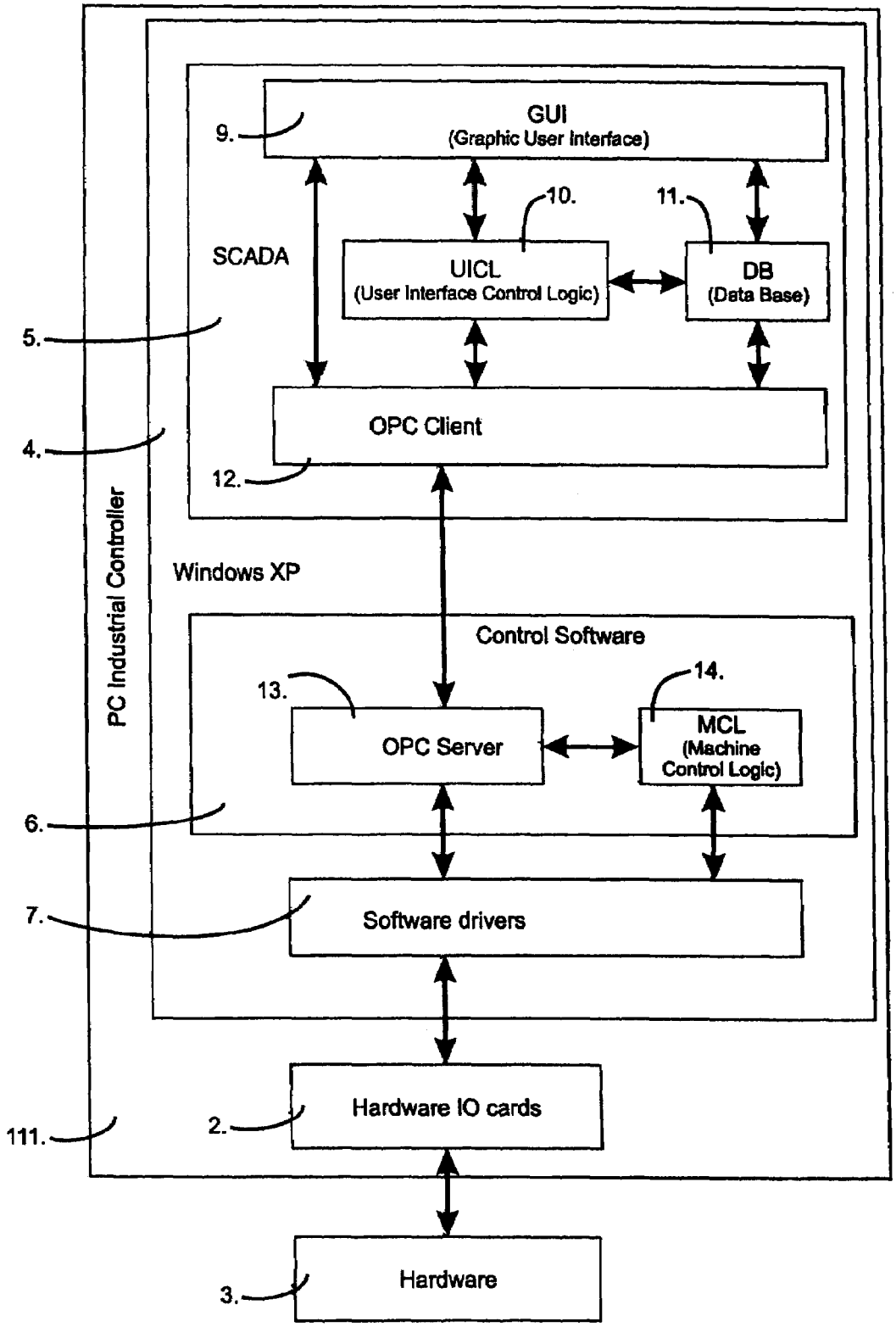
FIG. 4 is a schematic block diagram of the controller or computer of FIG. 2, illustrating the software levels of the controller.

FIG. 4 illustrates the organization of the software for the control system. The controller or computer 111 has built-in input/output cards 112 to 117 as described above, indicated by block 2 in FIG. 4. Block 3 illustrates the machine hardware controlled by the computer and providing signals to the computer, specifically the various motors and hydraulic cylinders controlling movement of the various moving parts of the machine, the sensors associated with that movement, the solenoid valves, and other components as described above and in my copending application referenced above and incorporated by reference herein.

Although the processing machine controlled by the system of FIGS. 4 to 22 is for performing grinding and/or polishing workpieces such as jewelry, the same basic system may be readily modified to control a similar machine with different types of workstations for carrying out different processing operations simply by modifying the input/output cards and software drivers based on the different hardware devices at the workstations. Other processing systems could still use the same gantry and gimbal transport mechanism.

A Windows XP® operating system 4 is used in the exemplary embodiment of the invention. It will be understood that other operating systems may be used in alternative embodiments. The operating system is programmed with a SCADA® based user interface 5, machine control software 6, and software drivers 7 for the I/O cards 2.

The software is organized in a number of levels, as indicated in FIG. 4. The highest level is a graphical user interface 9 which accepts commands from an operator and displays all needed data in dedicated windows. The user interface 9 is also a human-machine interface. The interface 9 provides two ways of communication to the OPC (object linking and embedding for process control) client 12, in that it accepts data for monitoring purposes and sends basic commands. This module also provides two-way communication to the User Interface Control Logic Module (UICL) 10 and the data base 11.

The UICL 10 and data base 11 are on the next level of the software. The UICL accepts commands from the graphical user interface (GUI) 9 and also provides needed data to the GUI. The UICL module also executes reading and writing data to the data base 10 during the automatic mode of operation and during the style training mode. The UICL also provides two-way communication to the next software level, OPC client 12.

The third level is the OPC client 12. The OPC client accepts data directly from the GUI, provides data for monitoring purposes, and accepts and sends data to UICL 10. The OPC client module 12 also provides two way communications to OPC server 13. The entire software for the system is based on a standard OPC client/server structure, which is commercially available from various manufacturers. One example of a suitable OPC server is made by Electronic Design Company of Shoreview, Minn., although OPC servers are also available from other manufacturers. OPC client is also commercially available software, and this system can use any OPC client that works under. C++ or Delphi language. One example of a suitable OPC client for this system is DOPC manufactured by KASSL GmbH of Langen, Germany, which works under Delphi. Another suitable product is WinCC or Windows Control Center that works under C++. This is a SCADA tool and OPC client made by Siemens Corporation of Munich, Germany. Both the OPC server and OPC client server may be purchased from different manufacturers if desired.

The OPC server 13 is on the fourth level. A machine control logic software module 14 is on the same level as OPC server 13. MCL is a procedure collection that provides all commands for machine motor motion. It also executes all other procedures in the process. The OPC server 13 and MCL module 14 provide two-way communication to the software drivers 7.

The software drivers 7 are on the next level. This is specialized software that enables conversion of electrical signals to software data and vice versa. In the illustrated embodiment of the invention, this software is specialized for the specific hardware used in the jewelry processing machine. Such software drivers are generally provided by manufacturers of controllers and input/output cards and may be part of a standard industrial controller or PLC controller. The software drivers 7 in one embodiment of the invention are provided by Electronic Design Company of Shoreview, Minn. The drivers may be adapted for the specific motors used in the system (in this case, Aries Motor drives) and for alternative hardware in different part processing applications.

Figure 5:
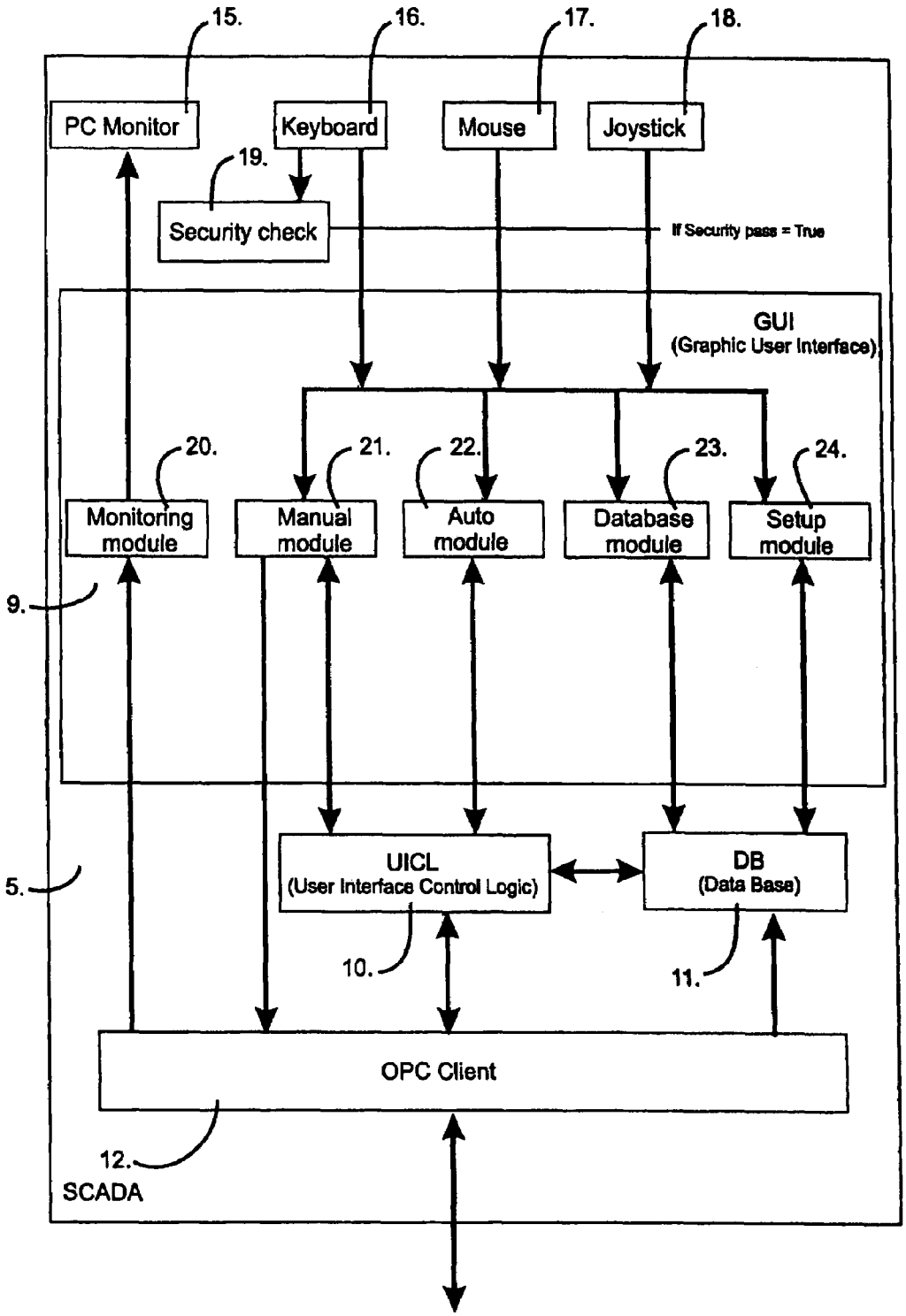
FIG. 5 is a block diagram illustrating the modules of the graphical user interface of FIG. 4.

The graphical user interface 9 is made up of five different modules, as illustrated in FIG. 5. A monitoring module 20 has the task of displaying all relevant data on PC monitor 15.

This module accepts data from OPC client 12 and displays the data on separate dedicated windows, refreshing the data on the screen every time something is changed.

The manual module 21 enables an operator to control all of the motors manually via keyboard 16, mouse 17 and/or joystick 18, and also enables tuning of all the parameters that are related to the production process. This module has five different command blocks, as illustrated in more detail in FIG. 6. These command blocks are as follows:

1. Motor movement commands (Block 25)

Commands 30 to 35 are used to allow the user to directly move each of the six motors for each of the six degrees of freedom (DOF) provided by the combined gantry and gimbal units, specifically the linear x, y and z motors and the rotational x, y and z motors. For each motor, a set of two buttons is provided which enables the motor to be moved in one or the other direction. These commands are sent directly via the OPC client to the software drivers 7. The operator is therefore able to move any motor directly in a desired direction, simply by clicking on the corresponding motor directional button (+ or – button). The motor stops when the button is released.

2. Predefined movements block 29

The commands of predefined movements block 29 are used by the user to initiate corresponding commands in the complex movement module 85 of the MCL (machine control logic) 14, as will be described below in connection with FIG. 10. These be used to move the gantry system quickly to a predefined position within the work space or envelope. There are a total of eight main points within the work envelope, and for each of these points there is a predefined command 52 to 59 which will initiate the complex movement procedure of FIG. 7 to move the gripper unit on the gantry system from its current position to that particular predefined position. The predefined movement commands are as follows:

(i) Go Home (52)—This command moves the system to "home" or (0, 0, 0, 0, 0, 0), i.e. the zero position for the x, y and z gantry sliders and the x, y and z gimbal motors.

(ii) Go Pick (53)—This command moves the gripper unit to a location above a first part (such as a ring) on tray 176 (or another tray if more than one tray of parts is present).

(iii) Go Grind 1 (54)—This command moves the gripper unit to a location in front of the first grinding wheel 133 (or in front of a polishing wheel if the system is set up for polishing).

(iv) Go Grind 2 (55)—This command moves the gripper unit to a location in front of the second grinding wheel 133*a* (or in front of a second polishing wheel if the system is set up for polishing).

(v) Go Crown (56)—This command moves the gripper unit to a crown polishing station at which ring crown polishing will take place.

(vi) Go Lap 1 (57)—This command moves the gimbal unit into a vertical gripper position for sprue removal.

(vii) Go Lap 2 (58)—This command moves the gimbal unit into a horizontal gripper position for sprue removal.

(viii) Go Flip (59)—This command moves the gimbal unit to the flip/regrip station 124.

3. Training block 27

The training block 27 is a block of commands that are used for training of the system, i.e. definition of all necessary operations for material removal that is relevant to a particular style of part or jewelry. This block is used to train the system in desired piece dependent motions using a joystick guidance method. The training block consists of the following five commands:

(i) Start 43 is the command for a training start. Execution of this command reserves a memory block for definition of a particular style.

(ii) The store position command 44 is used to define characteristic points on a desired trajectory of a ring during the material removal process. Execution of this command causes the instantaneous x, y and z coordinates of the gantry and gimbal units to be recorded as variables. At the same time, new variables are being defined for the next characteristic move. This command is instigated by the operator at the time when the system is located at the end point of a trajectory segment that is being executed. The command 44 is given by clicking mouse 17 or depressing a key on the joystick 18, which the operator may be moving in order to move the gripper unit along a desired trajectory. By recording the coordinates, one trajectory segment is defined and the next segment is ready for definition.

(iii) The store data command 45 is used to save presently set processing parameters from parameters block, 26 in the data base, as discussed below.

(iv) The store command 46 is used to record the last executed command within a sequence that defines a particular jewelry or part style.

(v) The end command 47 is used to end the style training. When this command is executed, all of the parameters used to define a style are stored in the data base. After this command, the software prompts the user to name a particular style which is associated with the stored style, so that it can be selected for future operations.

4. Parameter Set Up Block 26

This command block defines the parameters tied to the production parameters. The user can adjust the following parameters using the commands in this block:

(i) Gripper 2 force command 36 adjusts the gripping force applied at grip station 124.

(ii) Gripper 3 force command 37 adjusts the gripping force applied by gripping unit 123.

(iii) Grind force command 38 adjusts the contact force between a part held by gripping unit 123 and the grinding wheel, by control of the force applied by slide actuator 127.

(iv) Polish force command 39 adjusts the contact force between a part held by gripping unit 123 and a polishing wheel.

(v) Crown force command 40 adjusts the contact force between a part held by gripping unit 123 and a crown polishing tool (vi) Motor speed command 41 adjusts the speed (rpm) of the tool motors.

5. On/Off Commands Block 28

The On/Off command block 28 contains commands that govern the basic system functions. These are the gripper 2 on/off buttons 48 (buttons O and C) which provide commands to open or close the flip station gripper, the gripper 3 on/off buttons 49 (buttons O and C) that provide commands to open or close the gripper of gripper unit 123 carried by the gimbal unit, the flip command 50 that rotates the flip station gripper through 180 degrees, and the rouge command 51. The rouge command 51 activates application of a particular rouge to a particular polishing wheel. Before this command is executed, it is necessary to supply parameters that define which rouge applicator is to be activated along with a time which dictates how long the rouge application should last.

Figure 7:
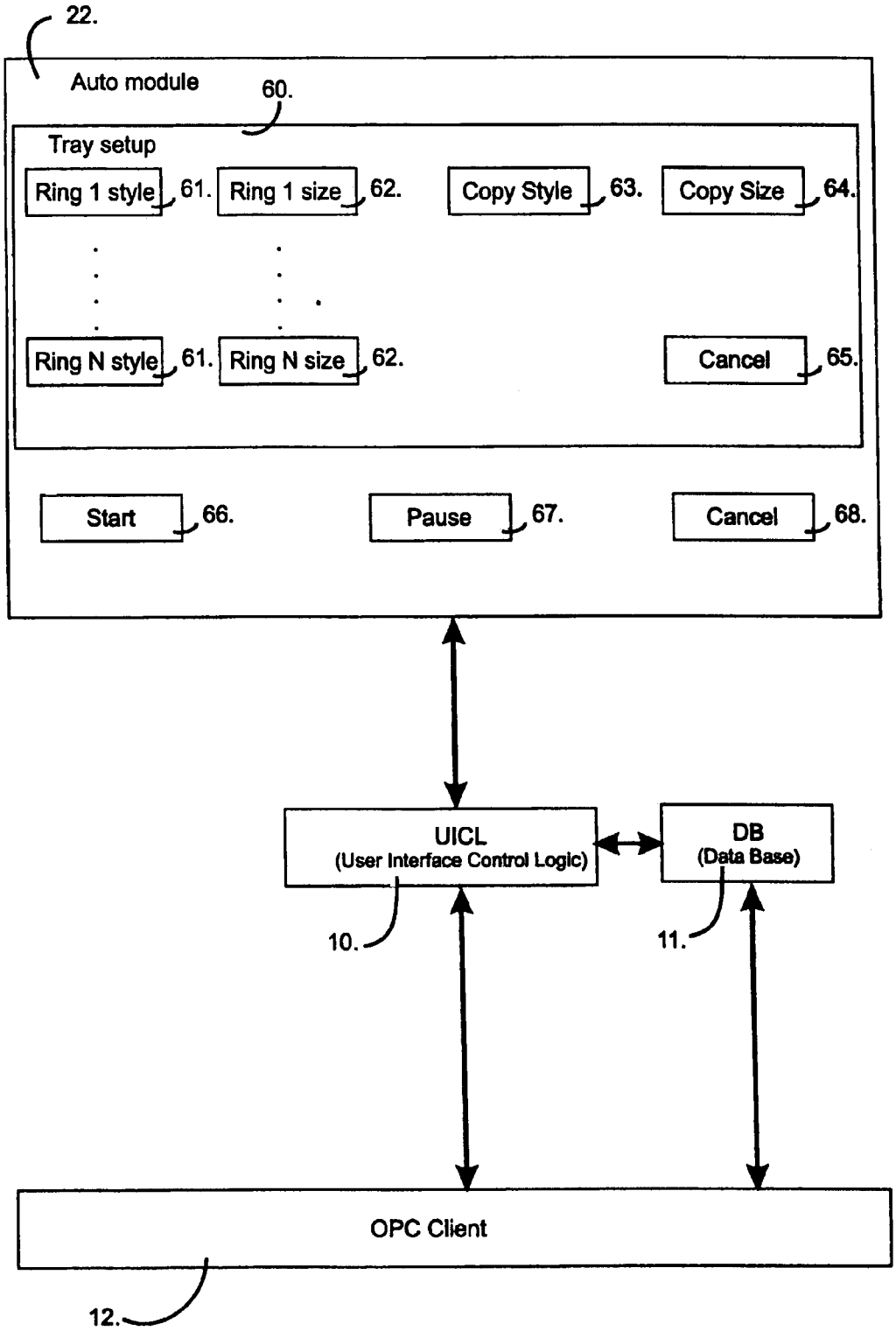
FIG. 7 is a block diagram illustrating the command blocks of the auto module of FIG. 5.

FIG. 7 illustrates the auto module 22 of FIG. 5 in more detail. This module contains a set of commands that are used to instigate an automatic production process. The commands within this block are found in a tray set up block 60, a start block 66, a pause block 67, and a cancel block 68.

The tray set up block 60 is a command block which is used to define the styles and sizes of rings that are set on the tray 176. In this block, there are two commands that are repeated as many times as there are rings that are set on the tray. There are three additional commands that allow a user friendly exchange while defining ring styles and sizes for rings on a tray. The commands in block 60 are as follows:

(i) Ring style 61—This command defines a ring style that is located on each position on the tray. For example, Ring 1 style defines the style of ring located at a first position on the tray, and Ring N style defines the style of ring located at the N-th position on the tray. This command is selected by selecting the name of a style from a drop down menu list. In the case in which there is no ring at a particular tray location, this position needs to be designated as "EMPTY", which is one of the possible style definitions. With this style designation, the system will skip over this position on the tray.

(ii) Ring size 62—This command is used to define ring size. Ring 1 size defines the size of the ring located at a first position on the tray, and Ring N size defines the size of the ring located at the Nth position on the tray. This command is executed by selecting a ring size from a drop down list or by typing in a corresponding number.

(iii) Copy Style 63—With this command, after a ring style is defined in block 61 for a particular N-position on a tray, it is possible to copy the same ring style onto subsequent tray positions.

(iv) Copy Size 64—With this command, after a ring size is defined in block 62 for a particular N-position on a tray, it is possible to copy the same ring size onto subsequent tray positions.

(v) Cancel 65—This command cancels any further work with size and style commands related to the configuring of a tray, indicating that tray set up is complete.

The start block 66 of module 22 is enabled when all rings on a tray are defined as to style and size. An operator can execute this command to start automatic ring processing. The pause command 67 is used to temporarily interrupt ring processing. The cancel command 68 aborts ring processing, and is enabled when the process is paused using command 67.

Figure 8:
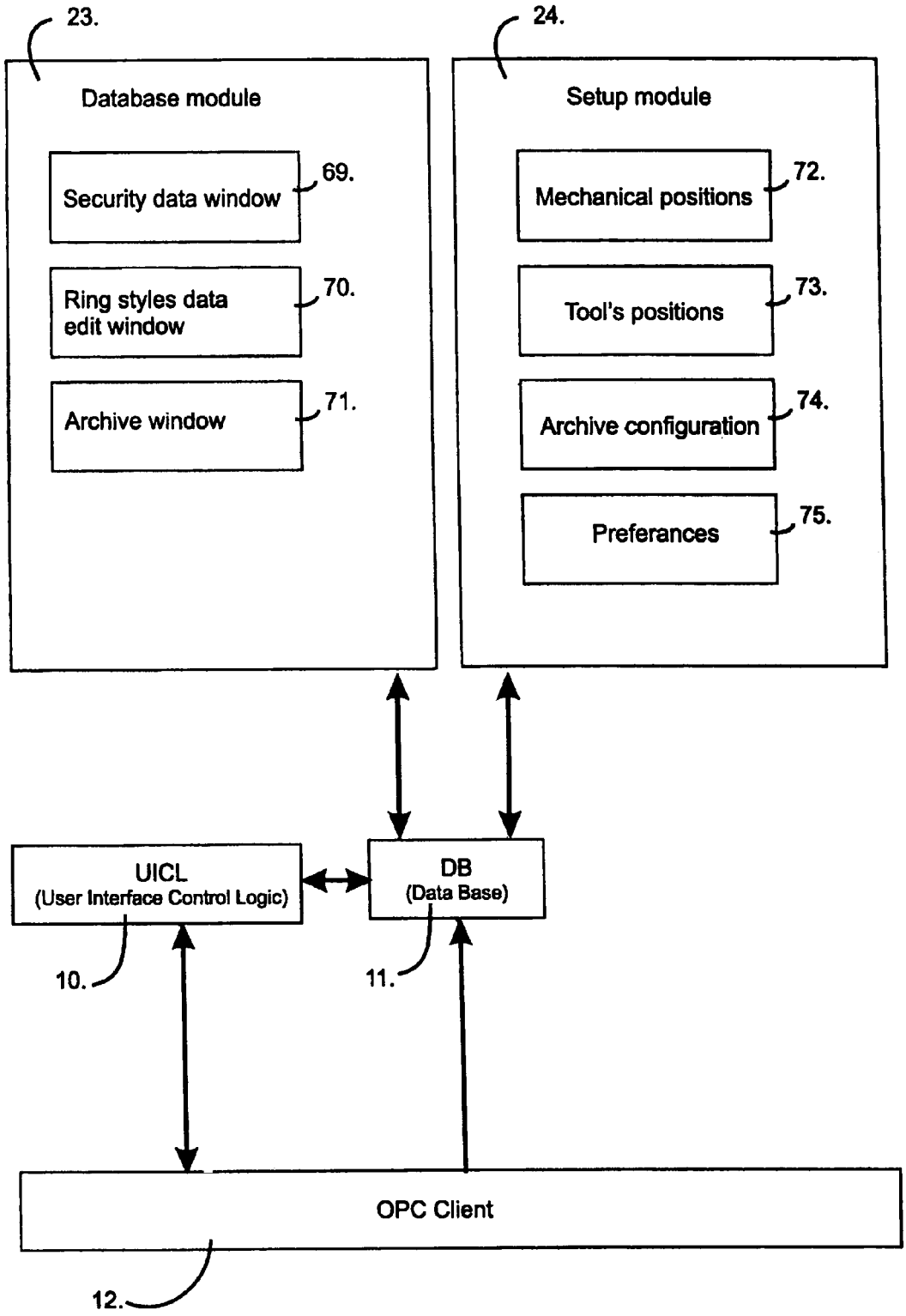
FIG. 8 is a block diagram of the windows of the data base module of FIG. 5.

The data base and setup modules 23, 24 of FIG. 5 are illustrated in more detail in FIG. 8. The purpose of data base module 23 is to update and organize data. This module has three windows, specifically a security data window 69, a ring styles data edit window 70, and an archive window 71. The security data window 69 allows for the editing of user changes, password changes, and admission changes. The ring styles data edit window 70 allows direct changes to be made within the ring style data base. The archive window 71 allows for an archive review.

The setup module 24 is used to set up basic parameters for both the hardware and the software of the system. This is where the basic calibration parameters are set. This module has four windows, specifically a mechanical positions window 72, a tool position window 73, an archive configuration window 74, and a preferences window 75.

The mechanical positions window 72 defines the basic work envelope configuration which is defined by the gantry and gimbal movement limits, i.e. the maximum and minimum position limits for all six axes of the system. Every axis has its own encoder that is placed on every motor of the gimbal and gantry. For one motor revolution causing movement along or about an axis, a corresponding encoder gives 4096 pulses. Every motor has a gear box or reducer. There is a different gear ratio for each degree of freedom. Data that define these ratios are saved as mechanical parameters of the system.

The tool positions window 73 is used to define the basic tool positions within the work envelope or area. The archive configuration window 74 is used to adjust data archiving parameters. Finally, the preferences window 75 is used to define environmental parameters. The environmental parameters are those that define window appearance on the screen, such as window placement, screen color, font size, and the like.

Figure 9:
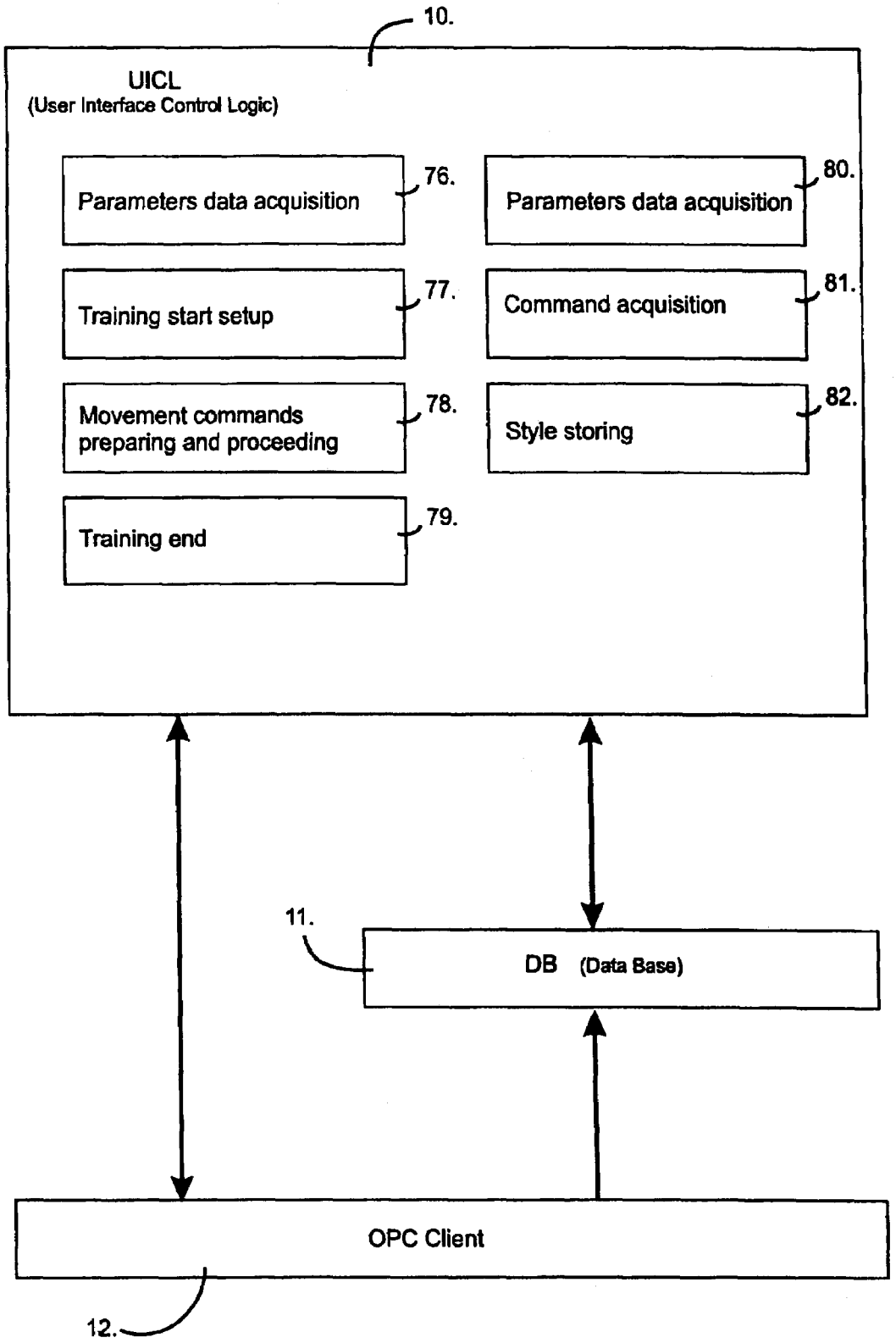
FIG. 9 is a block diagram of the procedures carried out by the user interface module of FIG. 4.

The user interface control logic module UICL 10 is illustrated in more detail in FIG. 9. This consists of the following seven procedures:

(i) A parameters data acquisition procedure 76. This procedure, accepts the motion data that is sent by the graphic user interface (GUI) 9 of FIG. 5 and sends it to the data base 11. This procedure also accepts motion data from the data base and sends it to the machine control logic (MCL) 14 (see FIG. 4).

Figure 6:
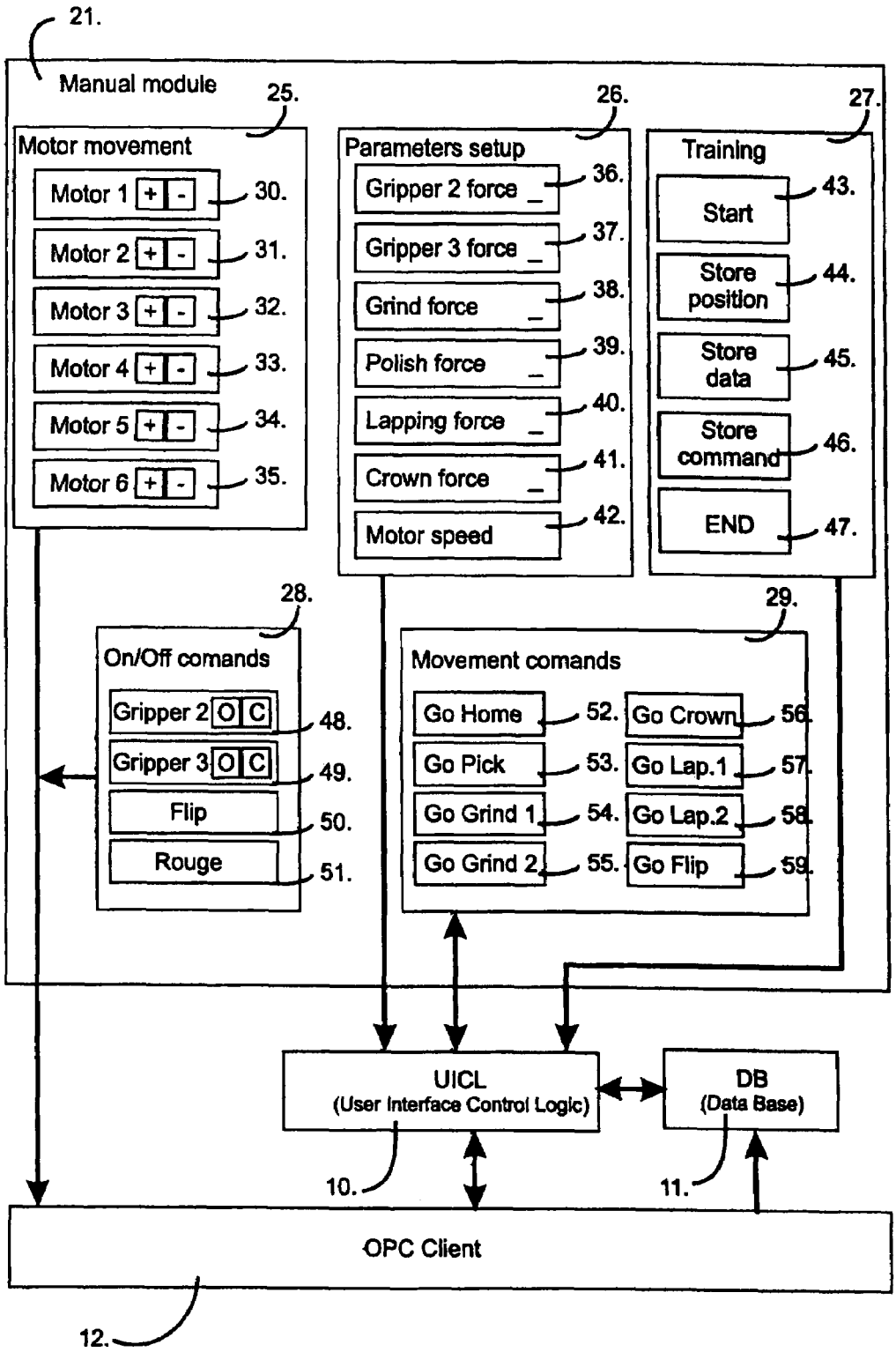
FIG. 6 is a block diagram illustrating the command blocks of the manual module of FIG. 5.

(ii) A training start setup procedure 77. This procedure is called up by the training start command 43 (FIG. 6). It defines all the variables that are needed for a style definition. It also reserves the necessary memory and prepares data for storage within the data base 11.

(iii) Movement commands preparing and proceeding 78. This command accepts requests for complex moves that originate from the graphical user interface GUI 9. It also defines current system coordinates and sends them to the machine control logic (MCL) 14.

(iv) Training ends procedure 79. This procedure is initiated by the training end function 47 (FIG. 6). This function releases variables that are not used and calls up the style storing procedure 82. After a style is stored or canceled, this procedure defines all of the variables that are needed to define a particular style. It also reserves memory and prepares data for storage within the data base.

(v) Parameters data acquisition procedure 80. This procedure accepts style data from the GUI 9 and sends it to the data base. The procedure also controls data conversion and special configuration files that define some styles. This procedure also acquires ring style data from the data base and sends this date to the MCL 14.

(vi) Command acquisition procedure 81. This procedure prepares the last executed command in training mode for writing to the data base.

(vii) Style storing procedure 82. This procedure prepares a style for writing to a data base.

Figure 10:
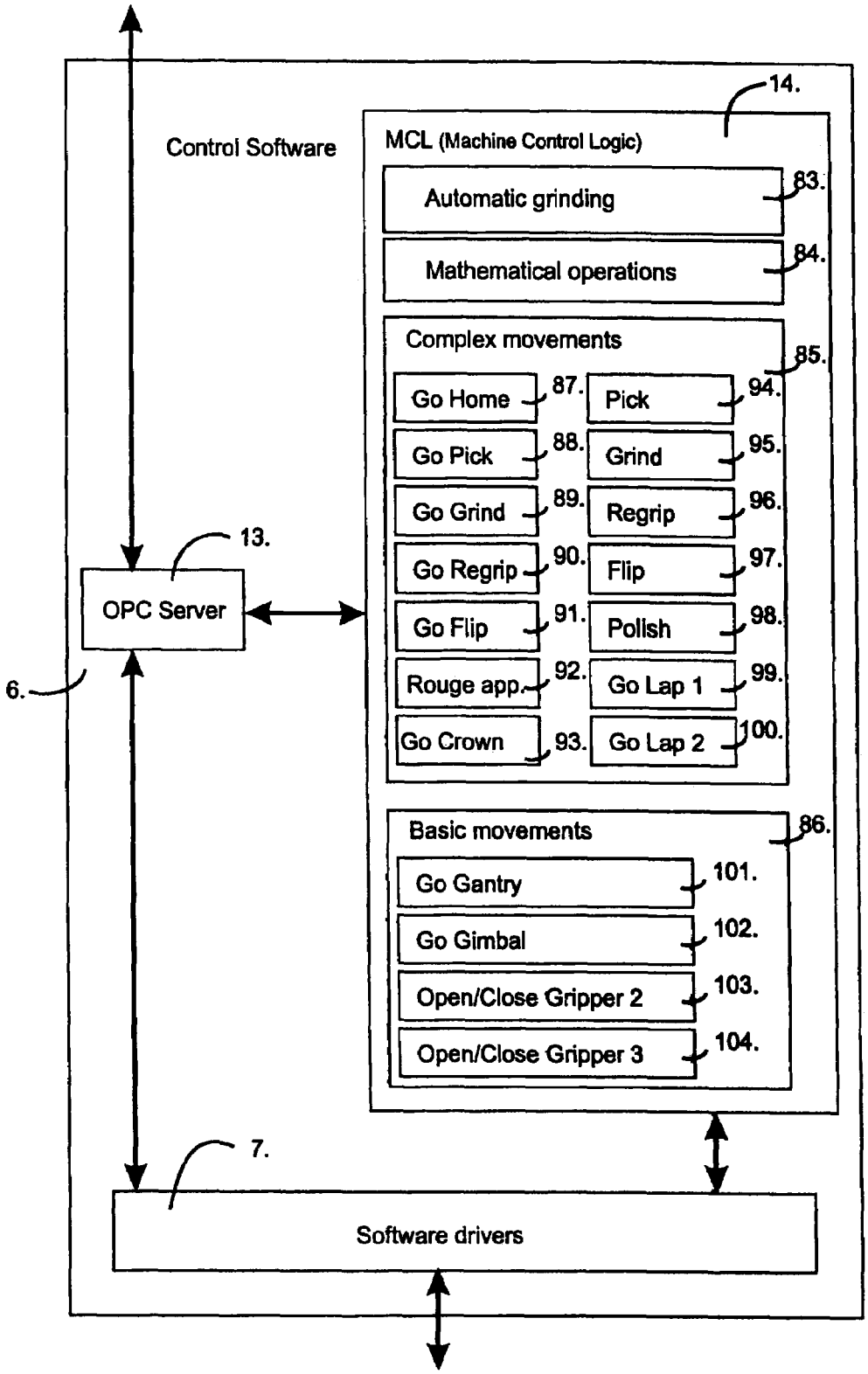
FIG. 10 is a block diagram of the machine control logic or software procedures of FIG. 4.

FIG. 10 illustrates the machine control logic (MCL) module 14 of FIG. 4 in more detail. This module contains an automatic grinding procedure 83, mathematical operations procedure 84, complex movements procedure 85, and basic movements procedure 86. The automatic grinding procedure 83 executes a series of commands that enable correct ring processing. Ring processing varies from ring to ring. Parameters that define a style, operation/command sequence, and other parameters are kept within the data base 11. This data is read by UICL 10 and is sent to the MCL 14 through the OPC client and the OPC server 13. Based on this data, the MCL processes a ring while executing a series of basic system motion commands, as described in more detail below in connection with FIGS. 11*a* to 11*c*.

The mathematical module 84 is a block of functions that is used to calculate motor angular velocities such that the resulting system motion when motors are running simultaneously is that the motors end their motion at the same time and the movement is smooth. In the case that the motion is required to be carried through a predetermined path, these functions discretize the trajectory and perform linear interpolation. In the exemplary embodiment of the invention, the math module will be in the Delphi program language. The functions comprise geometric and kinematic relationships between the degrees of freedom that can be derived starting from the geometry of the mechanism. Such functions can be found in standard robotic literature, as will be understood by one skilled in the field. The mathematical module keeps calculating necessary values that serve as the set point to the motion controllers. The following is one example of a series of algorithms which may be provided in the mathematical module in order to calculate motor angular velocities and provide these velocities to the software drivers.

In general gantry and gimbal units are controlled through the assignment of the number of impulses to the motor drives. This determines their position. The velocity is dictated by the frequency at which such impulses are supplied. As an example, an input to the motor corresponding to 1000 increments in the CCW direction to be achieved in 1 sec, consists of 1000 impulses that are sent to the drive at 1 KHz.

Whenever the motors are stopped system stores all of its positions in its memory and in the form of $(x_0, y_0, z_0, \theta_{10}, \theta_{20}, \theta_+)$.

In order to achieve a very first motor movement, it is necessary to bring all the motors to their zero position. It is also necessary to save all the system parameters that correspond to the position counter values. This particular position is labeled HOME. The motion of the gantry and gimbal units is always performed from its instantaneous position and in the following format.

$$\text{GANTRY}(\Delta x, \Delta y, \Delta z, \dot{x}, \dot{y}, \dot{z})$$

$$\text{GIMBAL}(\Delta\Theta_1, \Delta\Theta_2, \Delta\Theta_3, \dot{\Theta}_1, \dot{\Theta}_2, \dot{\Theta}_3)$$

Position parameters are directly supplied to the GANTRY( ) and GIMBAL( ) functions while the velocities are calculated for a time instant "t" and are provided by the mathematical block that contains the following expressions.

$$\dot{\Theta}_1 = \frac{\Delta\Theta_1}{t}$$

$$\dot{\Theta}_2 = \frac{\Delta\Theta_2}{t}$$

$$\dot{\Theta}_2 = \frac{\Delta\Theta_3}{t}$$

$$\dot{x} = \dot{\Theta}_2 * L * \cos(\Delta\Theta_2) + \frac{\Delta x}{t}$$

$$\dot{y} = \dot{\Theta}_1 * L * \cos(\Delta\Theta_1) + \frac{\Delta y}{t}$$

$$\dot{z} = \dot{\Theta}_1 * L * \sin(\Delta\Theta_1) - \dot{\Theta}_2 * L * \sin(\Delta\Theta_2) + \frac{\Delta z}{t}$$

Trigonometric functions that are used in the expressions above are also a part of the mathematical block. In the foregoing expressions, L is the length from the origin of the gimbal unit to the top of the gripper fingers (e.g., the center of the carried ring or part).

The complex movement procedures module 85 has a block of manually or automatically operated commands as follows:

(i) Go Home (87.)—This is the command that moves the hand or gripper unit 123 to start position (0, 0, 0, 0, 0, 0). The link (52.) to this command is in movement block (29.) of manual module (21.). The operator can execute this command directly using this link. This command can also be executed in the Auto mode. Executing of this command can be used for purpose of checking the machine's calibrating status. In one example of the system, hardware switches are provided for the zero positions of the x and y gimbal motors, while zero switches for the three gantry axes are defined by software and information regarding the position on these axes is provided via software drivers. The zero position of the z gimbal motor is detected only by count of encoder impulses. When all five switches (three gantry and two gimbal) are in the "on" position, the system checks if all encoder counts are zero, indicating the system is in the overall home position.

(ii) Go Pick (88.)—This is the command that moves the hand or gripper unit to a position for a pick of the first ring on the tray 176. Link (53.) to this command is in movement block (29.) of manual module (21.). The operator can execute this command directly using link. After processing of the first ring, destination coordinates for this command are set to second tray position and so on.

(iii) Go Grind (89.)—This command moves the hand or gripper unit to the start position for the grind process. Links (53. and 54.) to this command are in movement block (29.) of manual module (21.). The operator can execute this command directly using one of these links. Parameters of this command are grind wheel number (1 or 2) and coordinates of desired hand position. These coordinates are calculated based on a ring style and size. After the end of ring processing (exactly when force controller sensor closes contact), destination coordinates for this command are corrected for a difference between last stored position and a new position).

(iv) Go Regrip (90.)—This command moves the hand above the flip station. Considering that the positions for flip and re-grip can differ along the gantry's Z axis, there are two separate commands for flip and re-grip positioning.

(v) Go Flip (91.)—This command moves the hand above the flip station, and can be initiated automatically based on a stored program sequence, or by the user directly using the corresponding block or button 59 in the manual module 21.

(vi) Rouge Applicator (92.)—This command enables the contact between a rouge applicator and the wheel. Parameters for this command are the number of the rouge applicator that is to be activated and the time interval during which this application should last.

(vii) Go Crown (93.)—Command that moves hand to start position for crown polishing process. Link (56.) to this command is in movement block (29.) of manual module 21. The operator can execute this command directly using this link.

(viii) Pick (94.)—This command picks a ring from tray. Parameters for this command are tray position and height for ring gripping. It is initiated by GO PICK 88, which may be called based on a stored procedure or by the operator using the link from the GO PICK command button 53 of the manual module 21.

(ix) Grind (95.)—This command is called by automatic grinding procedure (83.) and it is a part of automatic ring processing. Parameters for this command are provided from the database.

(x) Regrip (96.)—This command enables switching between inside and outside gripping of the ring.

(xi) Flip (97.)—This command enables the rotation of the flip station gripper by 180°.

(xii) Polish (98.)—This command is similar to grind command. It is used for ring polishing purpose and executes ring polishing or crown polishing.

(xiii) Go lap 1 (99.)—This command moves hand to position for lapping of the ring. This command sets hand in vertical position.

(xiv) Go lap 2 (100.)—This command moves hand to position for lapping of the ring. This command sets hand in horizontal position.

In general, the GO movement commands in the movement command block 29 of the manual module 21 are simple commands that channel parameters to corresponding commands in the MCL 14. These commands correspond to screen buttons in the Graphical User Interface or GUI 9. By clicking one of these buttons, the operator opens a small window on the screen that enables input of command parameters. After these parameters are accepted, the system sends them to the corresponding GO command in complex movement block 85 for appropriate positioning of the gripper unit. The other (non GO) command blocks in block 85 are for actual processing of the ring. For example, GO LAP 1 will position a ring for a lapping procedure, and the corresponding command Grind 95 actually operates the grinding wheel to carry out the procedure.

Module 86 is a block of basic movement procedures. These are Go Gantry 99, Go Gimbal 100, Open/Close gripper 2 101, and Open/Close gripper 3 102. The Go Gantry command moves the gantry system from a current position to a position with coordinates defined by command parameters. Parameters for this command are gantry space x, y and z coordinates. When called, this command calls the mathematical module to define a path to the new position and then starts the gantry motors to move the gimbal unit and gripper or hand to the new position.

The Go Gimbal command moves the gimbal unit from a current position to a position with new coordinates defined by command parameters. Parameters for this command are gimbal x, y and z angles. When called, this command activates the mathematical module to define a path and then starts the gimbal motors to move the gripper unit to the desired x, y and z angular position.

Open/Close Gripper 2 is the command for opening or closing the two finger gripper of the flip station. Open/Close Gripper 3 is the simple command for opening or closing the three finger gripper of the gripper unit or hand on the gimbal unit.

The software is started automatically by turning on the computer. The software works under the Windows XP® operating system. If the software is interrupted, it can be restarted by clicking an icon which is provided on the desktop. After starting, the software first displays a window with fields having prompts for user entry of a user name and password. After this data is entered, the program checks the data base for the legal user name and password. If the password is valid, the program allocates the corresponding access level to the operator and shows the initial application window which has a selection of operations. The operator then selects the desired operation and starts the interaction.

One of the options provided to the operator is process monitoring. This program enables continuous monitoring of all of the system working parameters in real time. With the choice of the corresponding window, the operator may monitor all the measurable parameters (physical signals) as well as other, software based parameters that are vital to proper system operation. The process monitoring window will be displayed any time when ring or article processing is going on. This window will display all the parameters important for the process. These parameters for a ring processing application are as follows:

Size and style of ring that is currently being processed.

Tray position of the ring that is currently being processed.

Gripper forces

Force controller (tool bed) force.

Current operation.

Date and time of start of process.

Estimated time of end of process.

Current numeric coordinates of all axes.

RPM of tool motors.

Alarm panel with alarm states (if any condition goes out of limits, an alarm light is activated and an audible alarm signal is emitted).

Positions of the gantry and gimbal units will be shown graphically in one of the planes x-y, y-z, or x-z. The graphic plane can be chosen by the operator.

The system is also programmed to display average metal consumption, i.e. average material removed from the parts which have been processed. For ring processing, the material removed is a precious metal such as gold, so the amount which has been removed provides valuable information to the operator. This also provides an indication of how much material might be recovered by the filter unit 137. The amount of material removed per ring will be dependent on the ring style. When the system is set up, a procedure is carried out to calculate the average amount of precious metal removed for each programmed ring style. This is done as follows for each ring style and size:

1. Ten rings of the same size are weighed before processing.

2. The rings are processed according to the particular style.

3. The same ten rings are weighed after processing.

4. The difference in the ring weight before and after processing is calculated in order to determine the average amount of material removed per ring.

5. The same procedure is carried out for each different ring size and each different ring style.

6. The data base has a stored table of average material removal for each possible ring style and size.

During ring processing, the controller keeps a running total of the number of rings of each style and size which have been processed, and the average total material removed is calculated continuously using the table of stored values and the total number of rings processed. The average precious metal consumption is displayed to the operator. This allows the user to optimize the material removal process.

Another available option is manual operation. The manual control mode is used for system servicing and for training. When a manual mode is selected, a window appears that contains motor manual commands, commands for training and adjusting, or for system servicing. In the manual mode, the operator is able to move individual motors independently from each other while using corresponding buttons on the screen (see block 25 in FIG. 6) or with the use of a joystick.

The joystick can be used to control the motors of the gantry unit or the gimbal unit as needed, and the operator can select either type of movement.

When the joystick is used to control movement of the gantry sliders, movement of the joystick to the left will move the slider or carriage on the x-axis to the left relative to a: tray on the work plate. Movement of the joystick to the right moves the x-axis carriage to the right. If the joystick is moved forward, the y-axis carriage or slider is moved in the corresponding direction. Backward movement of the joystick results in movement in the negative y direction. If an upper button on the joystick is depressed, the gantry z motor is activated and the z-axis carriage or slider moves along the positive direction of the z-axis. If a lower button on the joystick is depressed, the motion is in the opposite direction along the z-axis.

If the operator selects gimbal operation under control of the joystick, then movement of the joystick to the left results in rotation about the y-axis of the gimbal unit, operating the y or yaw motor 210. Movement of the joystick to the right results in rotation in the opposite direction. Moving the joystick forward or backward results in clockwise or anti-clockwise rotation of the gimbal unit about the x axis under the control of x or pitch motor 209. If the upper joystick button is depressed, the z or roll motor 211 is activated to rotate the gimbal unit in a first or positive direction about the z axis. When the lower button is depressed, rotation in the opposite direction about the z-axis occurs.

These motions of the motors may alternatively be achieved by depressing corresponding + or − buttons 30 to 35 on the screen (see FIG. 6). These are labeled according to the axis that they influence and they are all provided in +/− pairs. Buttons are activated using the mouse.

If the operator selects training mode, all of the same commands are used. Training is started when the operator presses the training start button 43 that initiates learning of a new style by the system. In this mode, the operator conducts all the necessary ring processing operations manually. At the same time, the operator records all the instantaneous positions by clicking on the "store position" button 44. Using this command, characteristic path points are created and stored. While training, the operator can assign any desired number of points in order to define a path. The least number of characteristic points is defined so that every motion end point along any of the systems axes is stored. During the training, the operator also needs to store all the operations that are to be performed in a specific sequence that enables the correct processing of the ring. In the case where there is a change of a certain ring parameter, the operator needs to change the parameter and store its value.

The system works automatically during batch processing. Before starting, the operator needs to load the tray or trays 176. After this, the operator must define all the styles and sizes for each of the rings that are on the tray, using the tray setup procedure 60 (FIG. 7). The operator chooses "EMPTY" as the style for any tray location where there is no ring. After all of the ring tray positions have been designated, automatic batch processing is instigated by pressing the start button 66 on the screen.

Automatic batch processing may be interrupted by clicking on the PAUSE button 67. The operation can be restarted by clicking on the same button, which will now have a RESUME caption. Pause mode may also be entered automatically in the case of error scenarios such as when a ring is accidentally dropped by the gripper unit.

The operator may adjust preferences that dictate appearance of the control buttons on the screen. However, software configuration can be performed only by authorized service personnel.

Figure 11A:
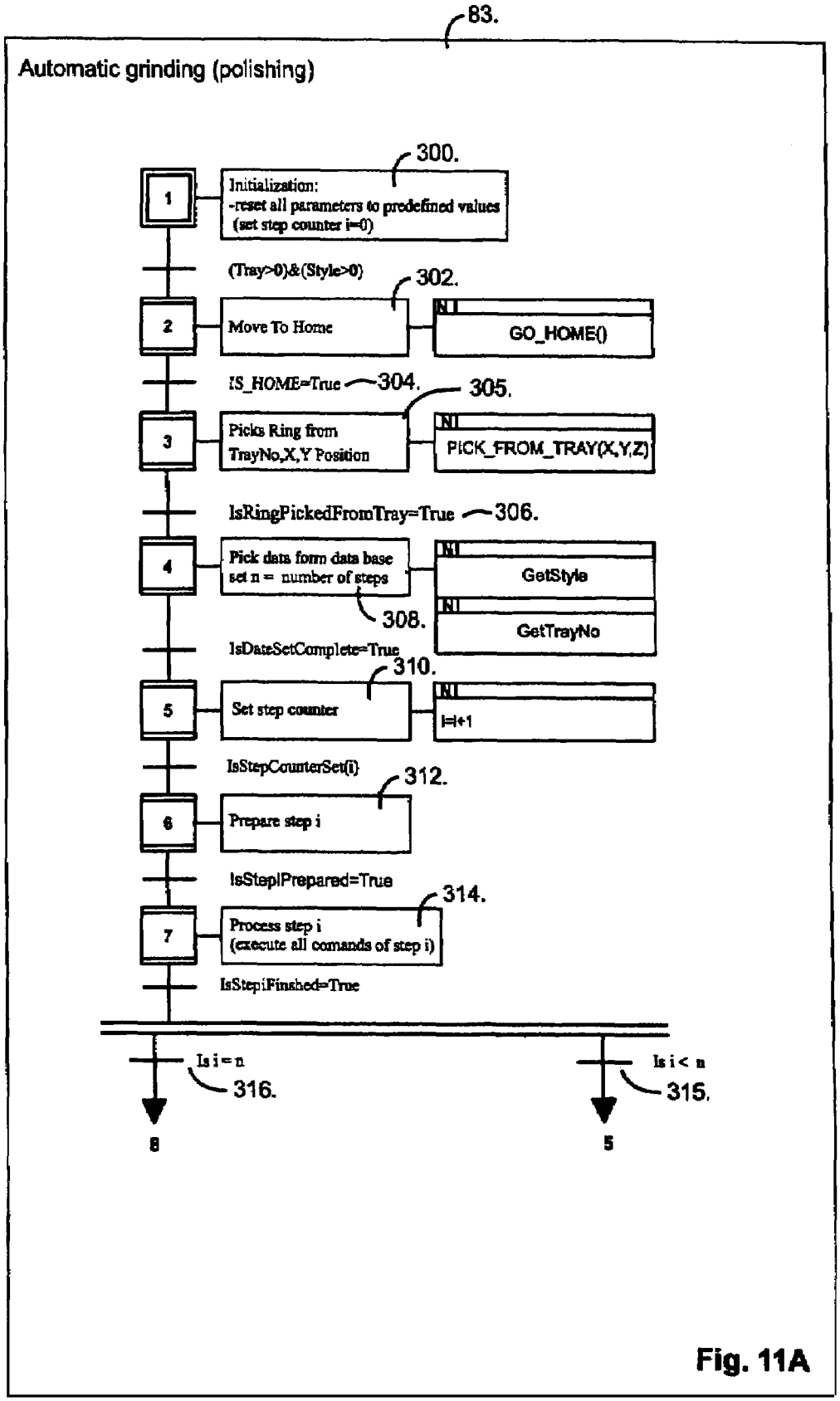
FIGS. 11*a* and 11*b* illustrate a general grinding or polishing procedure.
Figure 11B:
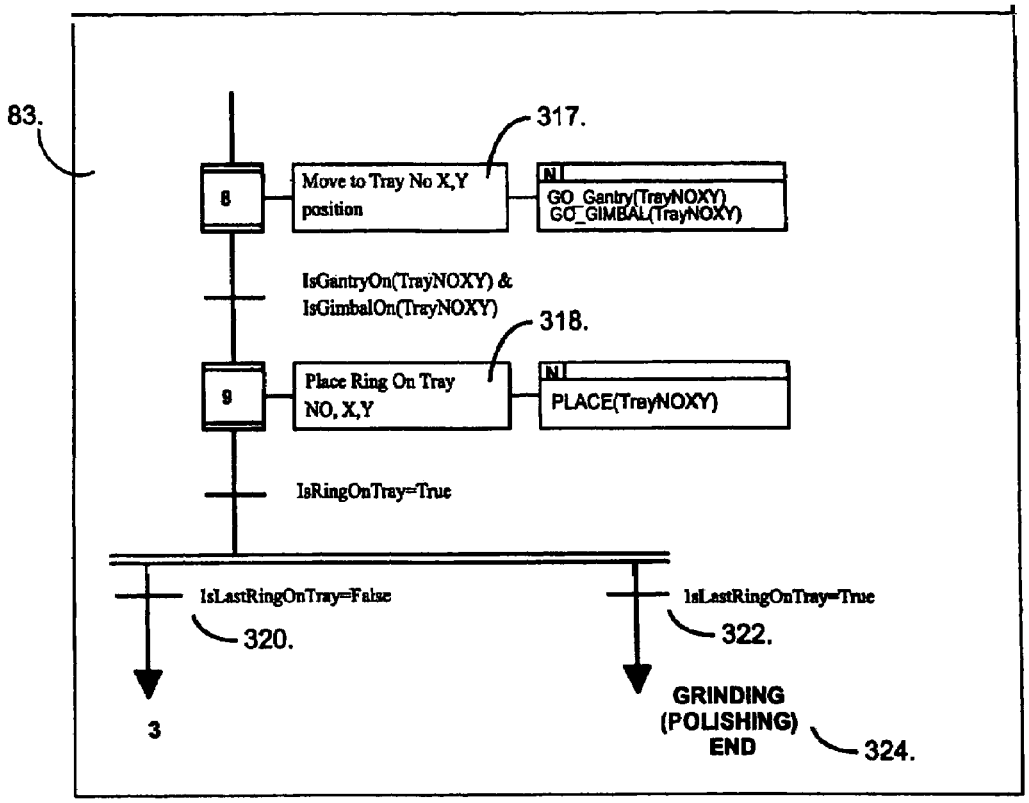
Figure 12A:
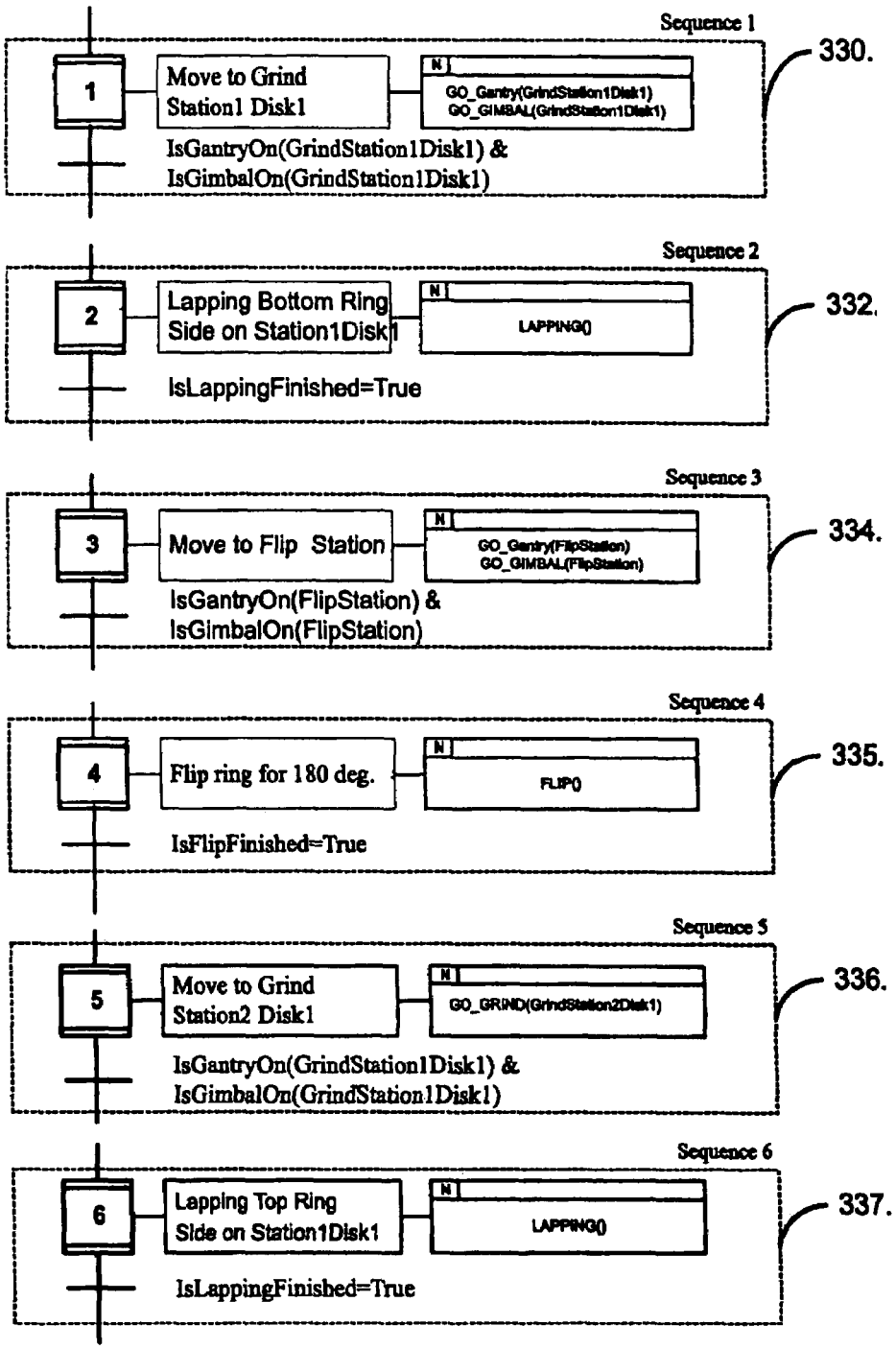
FIGS. 12*a* to 12*c* are software flow diagrams for one example of an automatic grinding procedure.
Figure 12B:
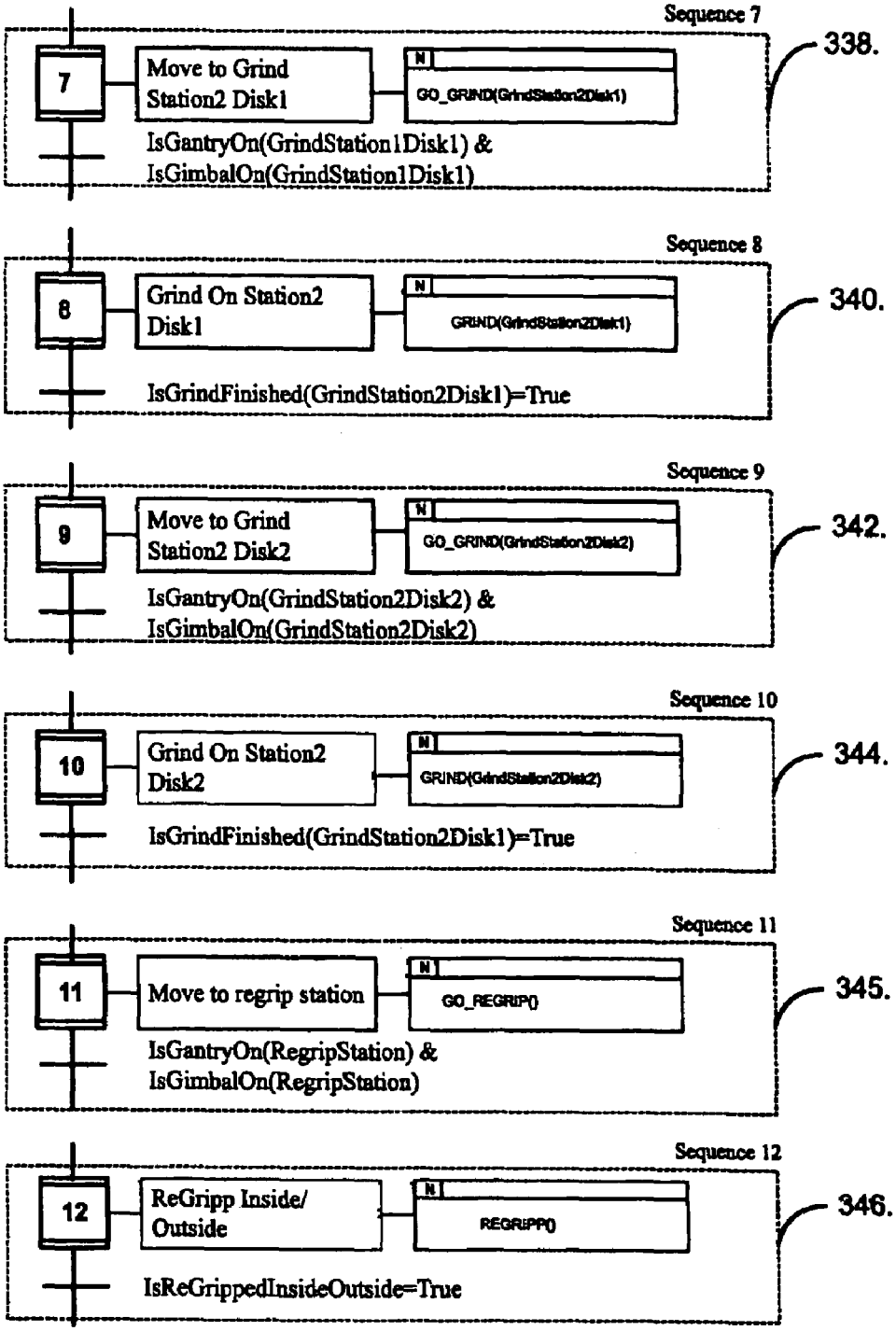
Figure 12C:
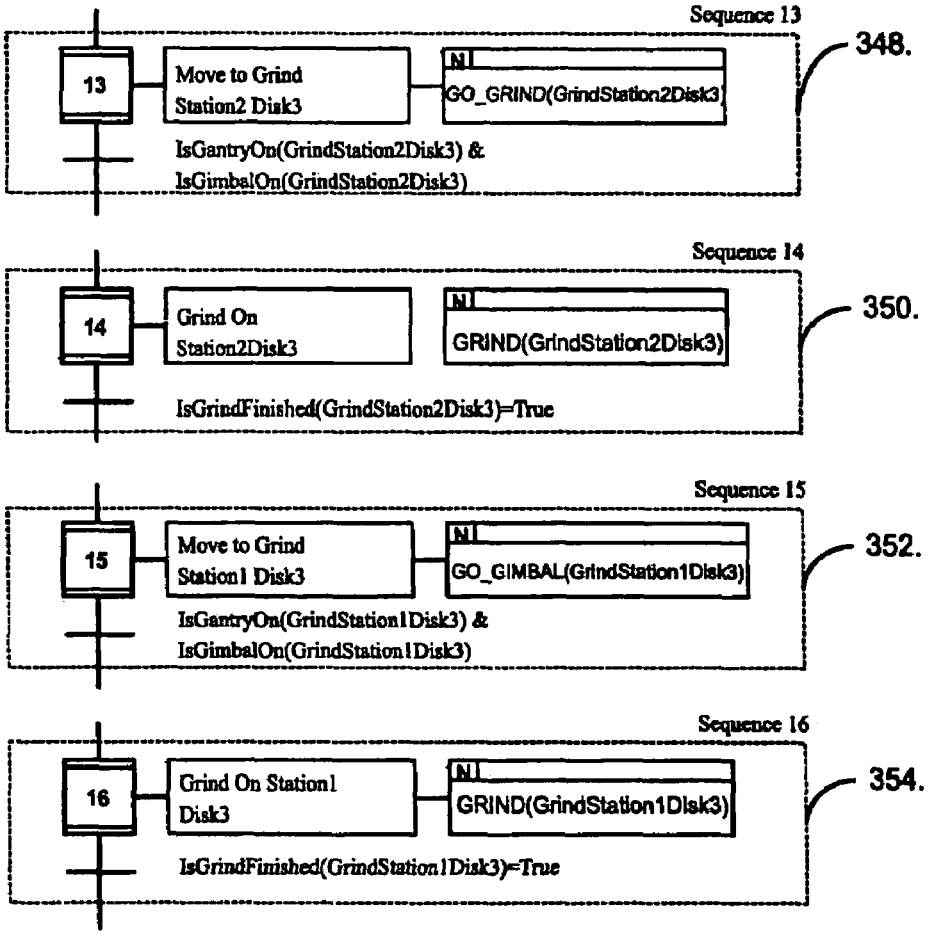
Figure 13A:
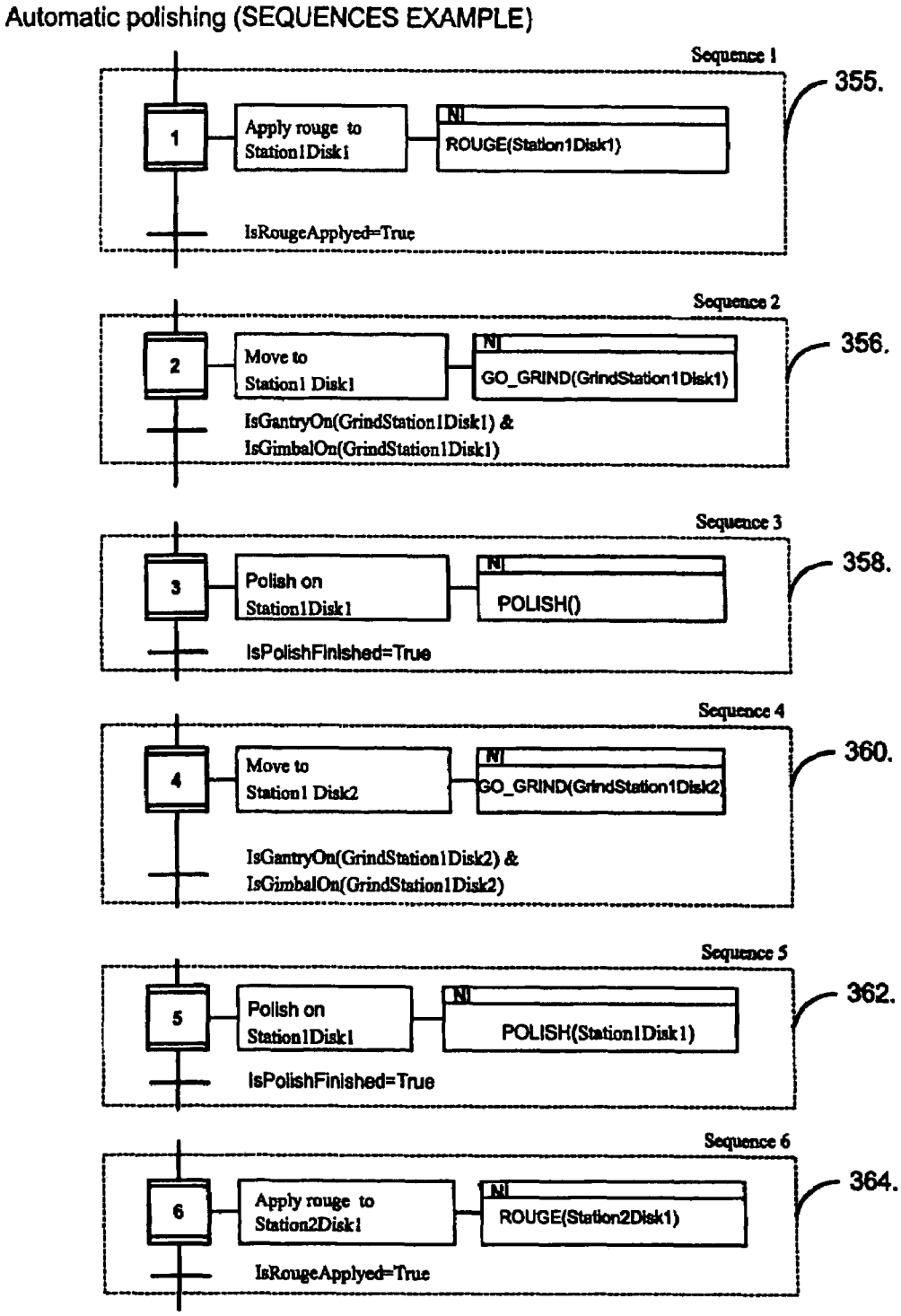
FIGS. 13*a* to 13*c* are software flow diagrams illustrating an exemplary automatic polishing procedure.
Figure 13B:
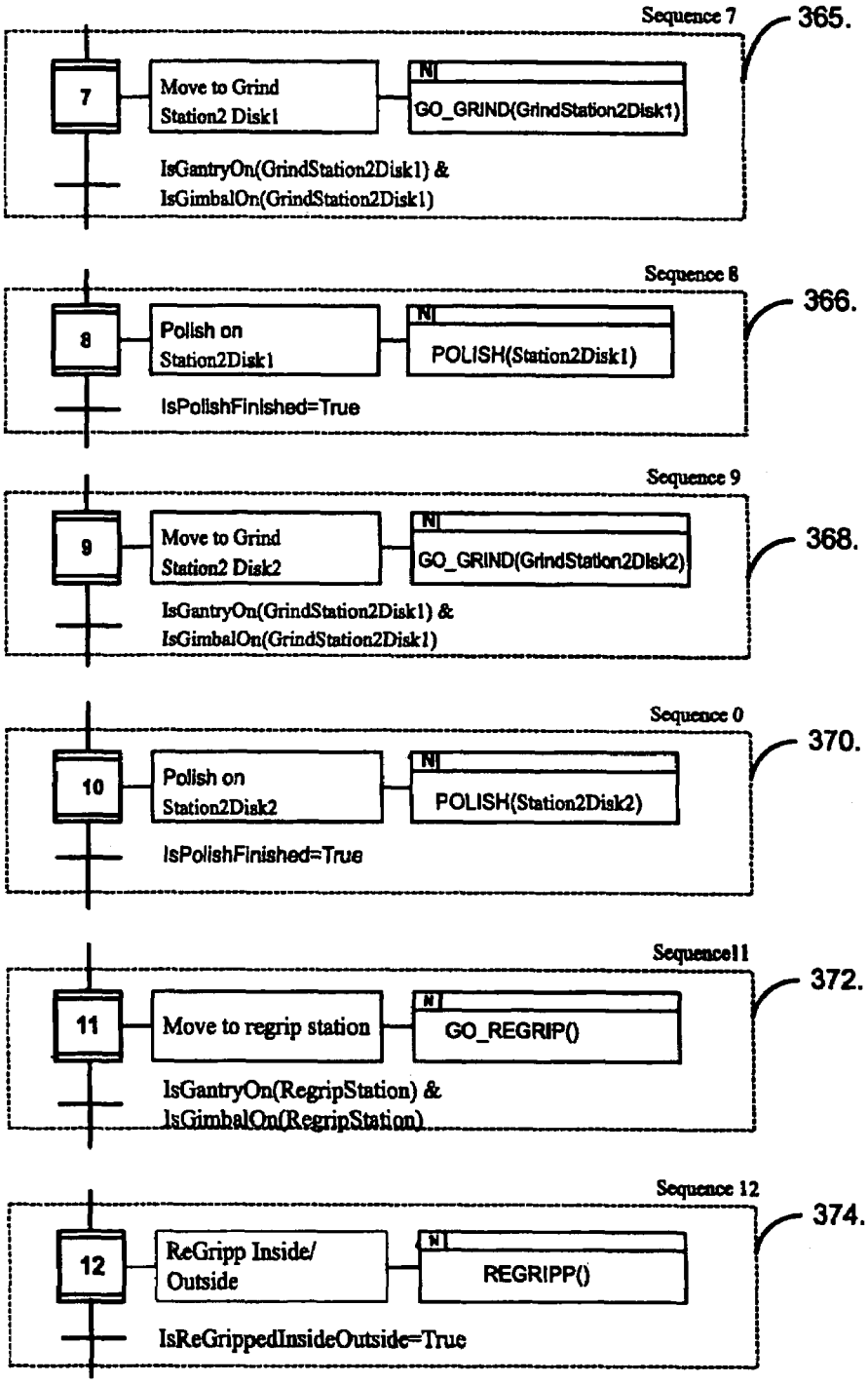
Figure 13C:
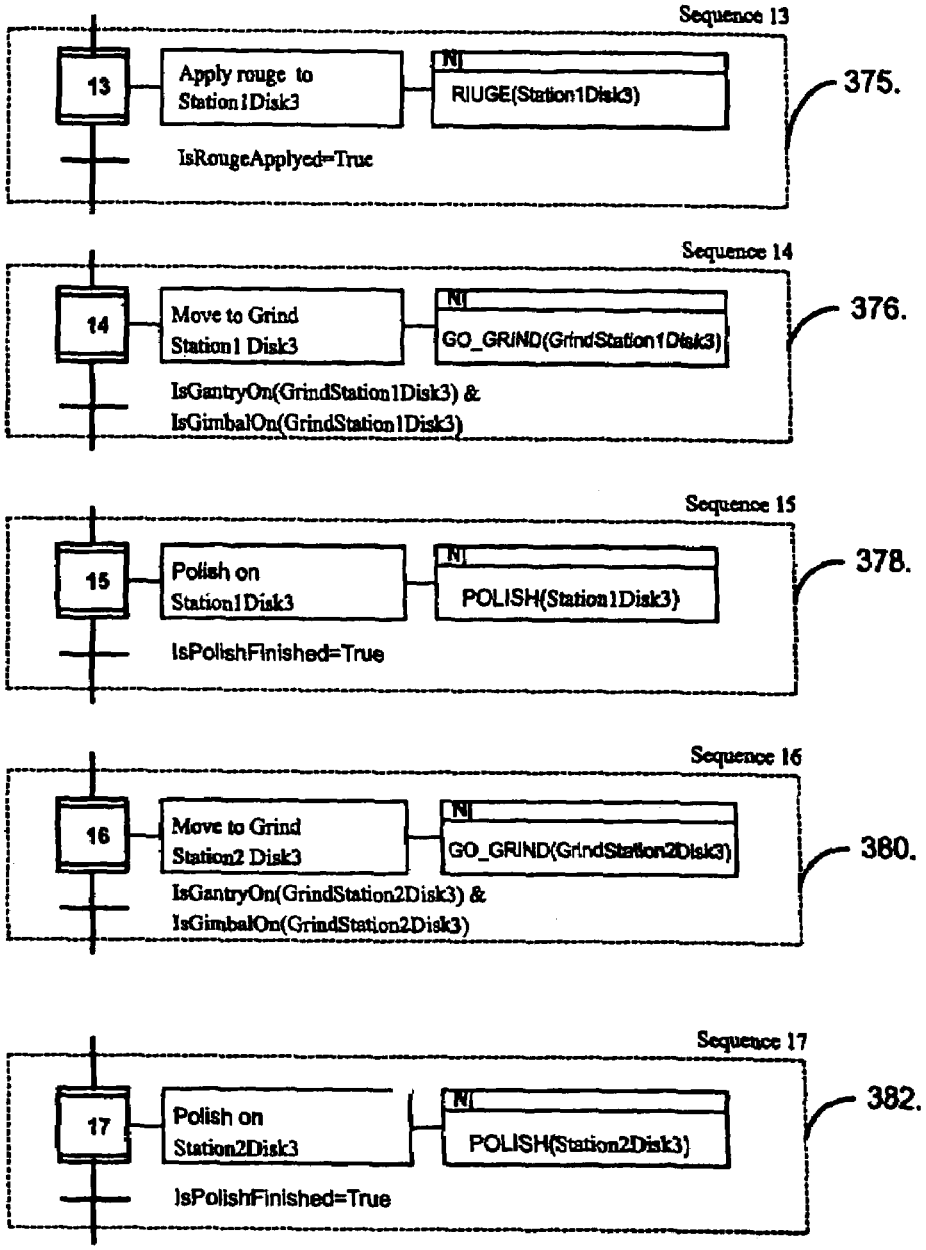

FIGS. 11*a* and 11*b* illustrate a software flow diagram for a general automatic grinding or polishing procedure, which will be carried out in automatic batch processing. FIGS. 12*a* to 12*c* illustrate an example of a detailed grinding sequence, while FIGS. 13*a* to 13*c* illustrate an exemplary polishing sequence. These sequences will be generated automatically during machine training. At the end of every sequence, the operator will save a sequence to the data base. A string of sequences will be connected to each different ring style.

At the start of the automatic grinding or polishing procedure (FIG. 11*a*), an initialization step 300 is carried out in which the tray number, ring style and ring size is obtained from the data base. In the next step 302, the gripper unit or hand is moved to the start or home position (0, 0, 0, 0, 0, 0). The next step 304 uses sensor output to determine when the home position is reached (IS HOME=True).

The system then moves the gripper unit to the first position on the tray and picks a ring from a specific x, y, z position, in step 305. Sensor outputs are monitored in step 306 to determine whether the ring has been successfully picked up from the tray (IsRingPickedFromTray=True). In step 308, data on the selected processing sequence is obtained from the data base and the number of steps n is set. In step 310, the number of steps is set. In the subsequent steps 312, 314, a sequence of predetermined processing (grinding or polishing) steps is carried out successively, based on the ring style and the trained processing sequence. When there are still steps to be carried out (315), the system returns to step 312 to carry out the next processing stage. When all steps in a processing sequence are complete (316), the ring is moved to the desired tray position (317), and the ring is deposited on the tray (318) back in its original position. When there are still rings remaining to be processed on a particular tray (320), the system returns to step 302 and repeats the sequence with the next ring. When all rings on a tray have been processed (322), the grinding or polishing procedure ends (324).

There may be a total of two stations for either grinding or polishing (with the grinding wheels switched for polishing wheels when a polishing procedure is to be carried out). Each station has a lower wheel for outside grinding or polishing (six inch diameter wheels) and an upper wheel for inside polishing (around 0.5 to 0.7 inch diameter wheels). There may be one or two larger diameter wheels at each station.

As noted above, FIGS. 12*a* to 12*c* illustrate one possible example of a ring grinding sequence, although other sequences may be trained for different ring styles and requirements. For this sequence, the following grind stations are provided:

Station 1 with three different grinding disks or wheels, i.e. Disk 1 which is a lapping wheel or rubber wheel with sandpaper cover, Disk 2 which is an outside rough grind wheel, and Disk 3 which is a smaller, inside diameter rough grind wheel.

Station 2 with three different grinding disks or wheels, i.e. Disk 1 which is an outside contour grinding wheel, disk 2 which is an outside contour fine grind or pre polishing wheel, and disk 3 which is an inside diameter fine grinding wheel.

In the first step 330 of the procedure, the ring is moved to the grind station of the first grinding wheel, by suitable operation of the gantry and gimbal motors. A self-check is performed in step 330 to determine when the gantry and gimbal units are at the correct six coordinate location.

The next steps are for performing a lapping operation on both side faces of the ring. First, in step 332, the ring is moved into a vertical orientation with the first side facing the grinding wheel at the first grinding station, and the grinding wheel and the slide force controller are activated in order to apply the programmed grinding force at the programmed grinding wheel motor speed for the programmed duration of time. Step 332 also determines when lapping is complete. The end of the lapping procedure is calculated mathematically.

When it is determined that lapping of the first side of the ring is complete, the ring is moved to the flip station (step 334). The system determines when the gantry and gimbal units are properly positioned at the flip station based on programmed parameters. The flip station is then actuated to take the ring from the gripper unit and flips or rotates the ring through 180 degrees (step 335), and the ring is regripped by the gripper unit to present the opposite side face of the ring for lapping. When the flip procedure is determined to be finished, the system is controlled to move the ring back to the first grinding station and first grind wheel or lapping wheel by programmed operation of the gantry and gimbal motors (336). When the ring is determined to be at the proper location for lapping, the grind wheel and tool bed force controller are actuated to perform the lapping operation to remove sprues from the opposite side face of the ring (step 337).

After lapping is complete, the ring is moved to grind station 2, disk 1 (step 338) and a contour grind of the outside surface of the ring is carried out (step 340). The ring is then moved to grind station 2, disk 2 (step 342) and fine grinding or prepolishing of the outside surface is carried out (step 344). On completion of this step, the ring is moved back to the flip/re-grip station (Step 345), and the ring is re-gripped on the outside surface to leave the inside surface free for grinding (346).

In step 348, the ring is moved to grind station 2, disk 3 (inside rough grind wheel). Grinding is carried out with disk 3 on the inside surface of the ring (step 350), and the ring is then moved to grind station 1, disk 3 (inside fine grind wheel) in step 352. Fine grinding of the inside surface of the ring follows in step 354.

It will be understood that a greater number of grinding wheels and grinding steps with different grinding levels may be provided if desired.

A possible polishing sequence will now be described with reference to FIGS. 13*a* to 13*c*. This sequence uses the following polishing stations and polishing wheels:

Station 1, disk 1—Outside fine polish, muslin wheel
Station 1, disk 2—Outside rough polish, bristle wheel
Station 1, disk 3—Inside rough polish, bristle wheel
Station 2, disk 1—Outside fine polish, muslin wheel
Station 2, disk 2—Outside rough polish, bristle wheel
Station 2, disk 3—Inside fine polish, felt bob wheel.

In the polishing procedure, rouge is first applied to disk 1, station 1 (step 355). The ring is then moved to station 1, disk 1 (step 356), and the ring is polished using predetermined polishing parameters (step 358). After polishing is complete, the ring is moved to station 1, disk 2 (step 360), and the ring outer surface is polished (step 362). No rouge is applied to any bristle wheels prior to the polishing step. In step 364, rouge is applied to disk 1 at station 2. The ring is then moved to station 2, disk 1 (365), and the outside surface is polished (366). Next, the ring is moved to station 2, disk 2 (368), and polished (370). In the next step (372), the ring is moved to the re-grip station and the ring is re-gripped on the outside surface (374).

Rouge is then applied to station 1, disk 3 (small diameter wheel) in step 375, and the ring is moved to station 1, disk 3 (376). The inside surface of the ring is then polished (378), and the ring is moved to station 2, disk 3 (380), and the inside surface is again polished (382). This ends the polishing sequence.

Figure 14:
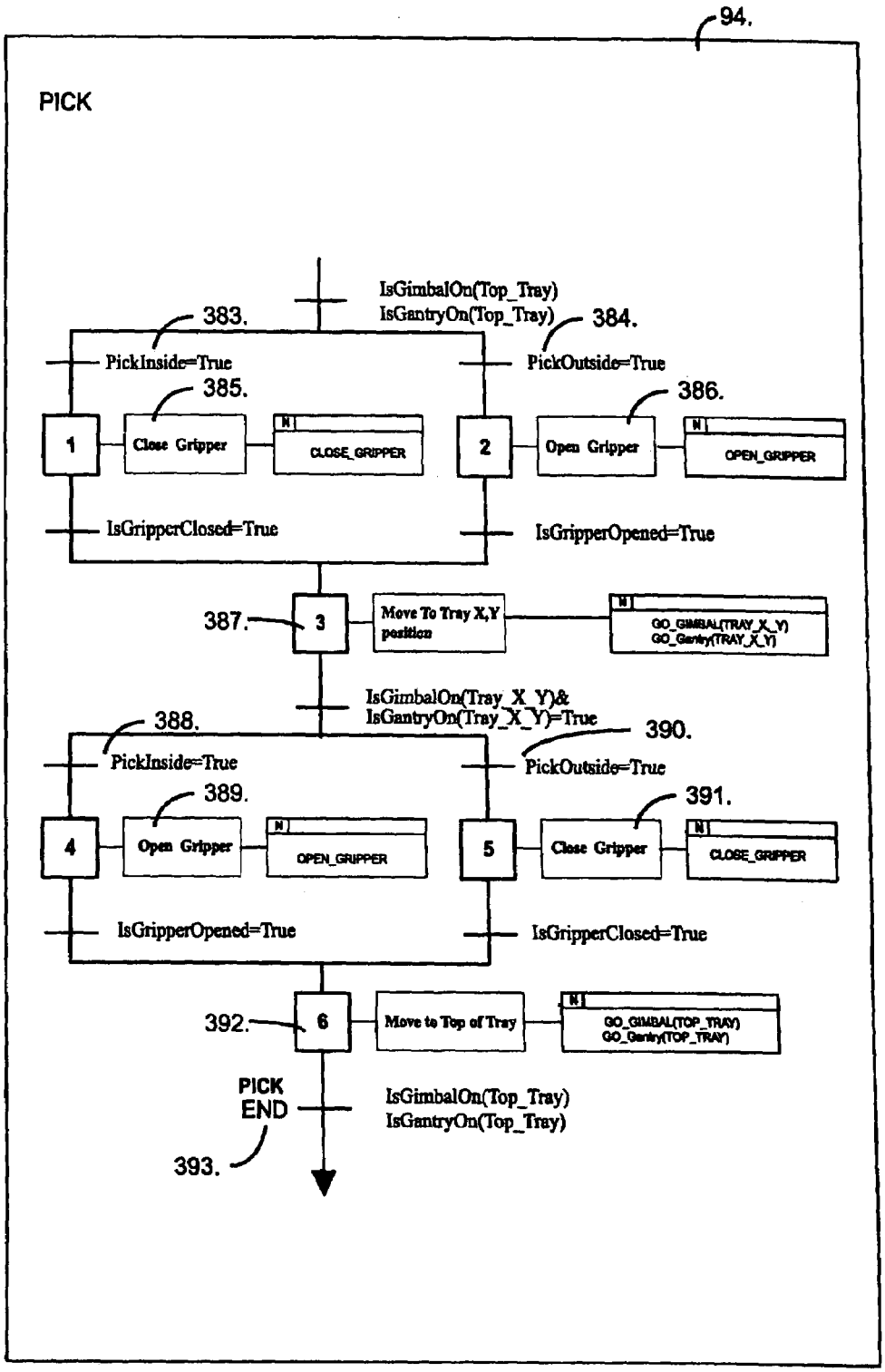
FIG. 14 is a software flow diagram of the pick procedure of FIG. 10.

FIG. 14 illustrates the steps carried out in the PICK procedure 94 of FIG. 10. This is used in order to pick up the next jewelry piece to be processed. First, it is determined whether the ring is to be picked from the inside (383) or the outside (384). If the ring is to be picked up from the inside, the gripper fingers must be closed in order to prepare to pick up the ring (step 385). If the ring is to be picked up from the outside, the gripper fingers must be open in order to prepare to pick up the ring (step 386). Once the gripper is in the proper position (open or closed), the gantry and gimbal motors are controlled to move the gripper to the proper tray x, y position at the next ring to be processed, and the gripper is moved down so that the fingers are located inside the ring for an inside pick, or outside the ring for an outside pick (step 387). If the ring is to be picked up from the inside (388), the gripper fingers are opened (389). If the ring is to be gripped from the outside (390), the gripper fingers are closed around the ring (391). After that, the gripper is raised so that the ring is removed from the holder on the tray (392). When the ring is taken off the tray, the pick procedure is ended (393).

Figure 15A:
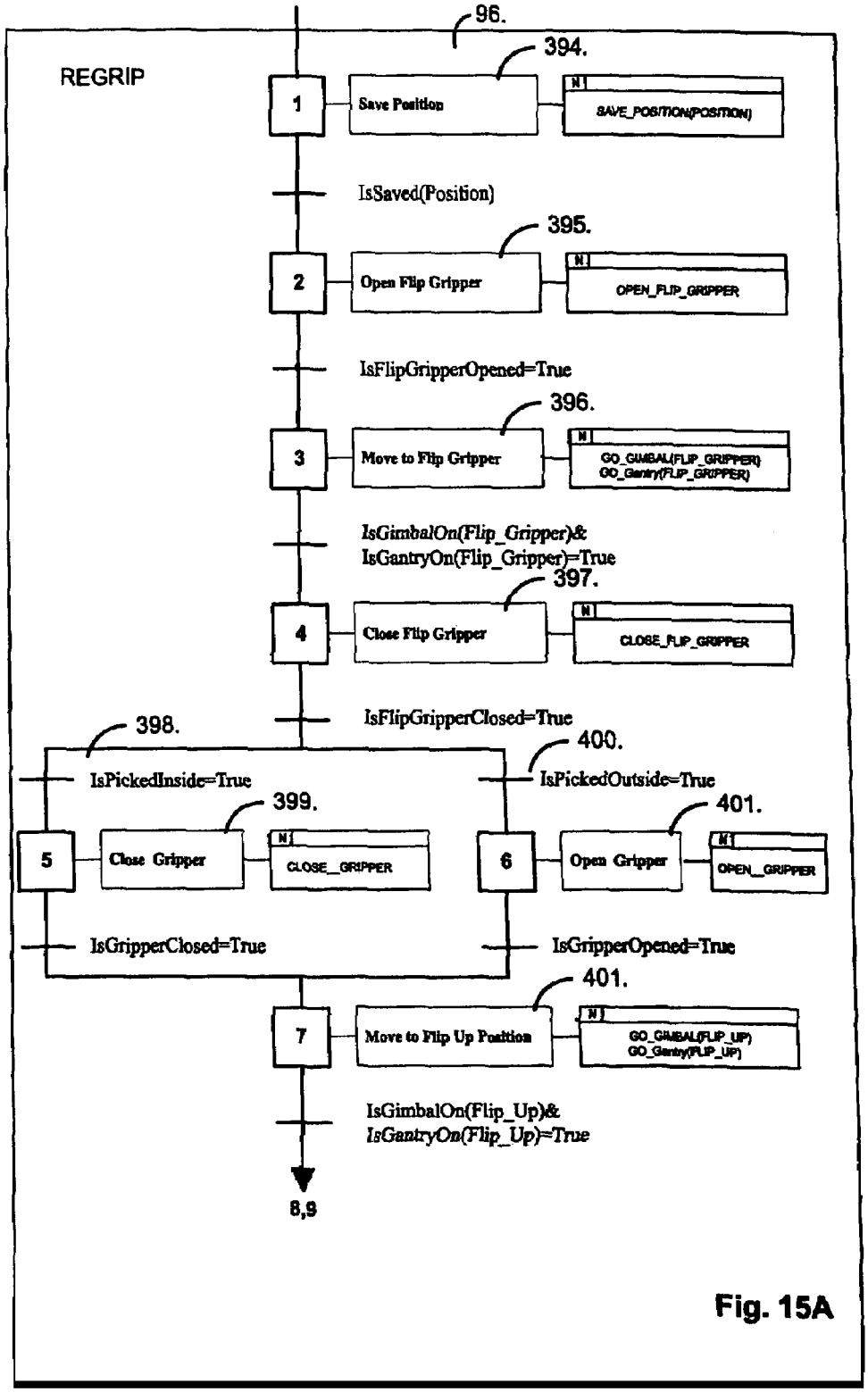
FIGS. 15*a* and 15*b* are software flow diagrams of the regrip movement procedure of FIG. 10.
Figure 15B:
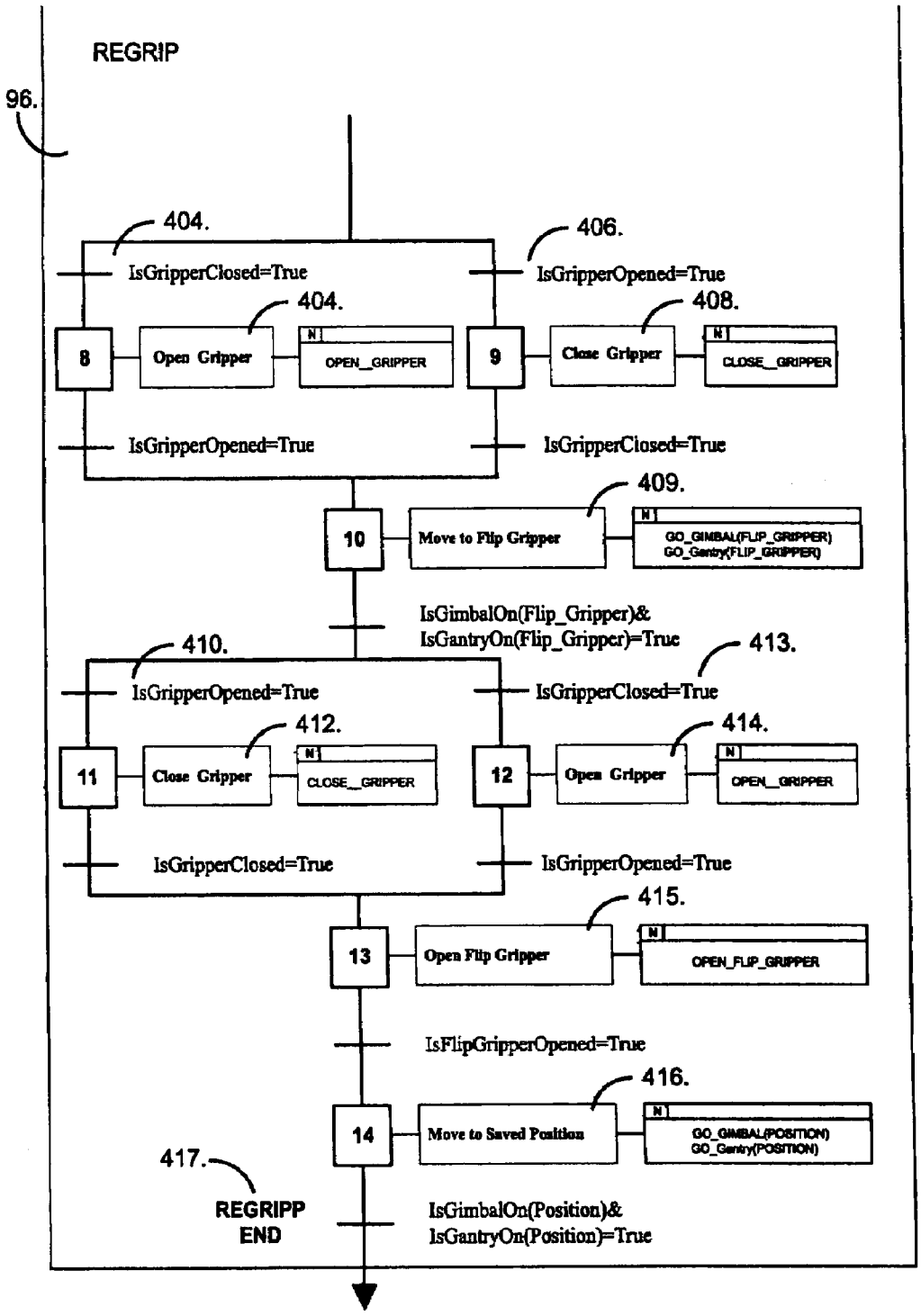

FIGS. 15*a* and 15*b* illustrate a regrip procedure 96 in which a ring is moved to the flip station so that the gripper can regrip the ring to expose a different surface for grinding or polishing. In this procedure, the current piece orientation and position is first saved (394), and the flip gripper is opened (395). The gripper on the gimbal unit is then moved to the flip gripper (396), and the flip gripper is closed (397). At this point, the ring is held by both the flip gripper and the gimbal gripper. If the ring is gripped by the gimbal unit gripper from the inside (398), the gripper fingers are closed (399) in order to release the ring from the gripper unit. If the ring is gripped by the gimbal unit gripper on the outside (400), the gripper fingers are opened (401) so as to release the ring. In either case, this leaves the ring held by the flip gripper alone.

The gimbal and gantry units must then be operated to move the gripper unit upwardly, out of the way of the flip gripper (step 402). In the next steps, the gripper unit is prepared to pick the ring up from the opposite side than it was gripped before. If the gripper unit is to regrip the ring from the outside, and the gripper is closed (404), the hand or gimbal unit gripper is opened (405). If the gripper unit is to regrip the ring from the inside (406), it is closed (408) in preparation for the regripping operation.

The gantry unit is then operated to move the gripper unit back down to the flip gripper (409), until the gripper fingers are positioned inside or outside the ring. If the gripper fingers are open (410), they are then closed to grip the ring (412). If the gripper fingers are closed (413), they are opened to grip the ring from the inside (414). The flip gripper is then opened to release the ring (415). The next step (416) moves the ring to the position it was in prior to the regrip command. The regrip procedure is then complete (417).

Figure 16:
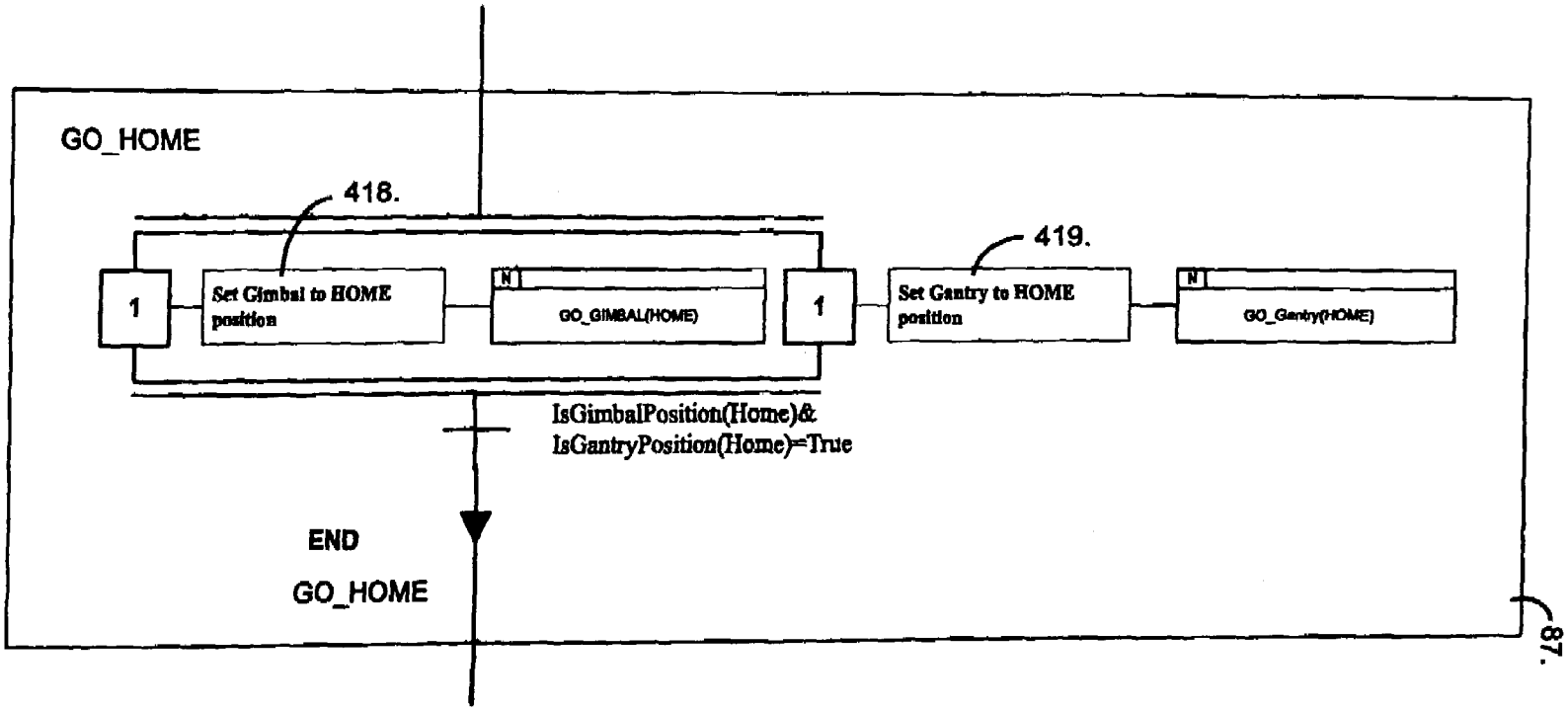
FIG. 16 is a software flow diagram of the home movement procedure of FIG. 10.

FIG. 16 illustrates the GO HOME procedure 87 of FIG. 10. In this procedure, the gimbal and gantry motors are controlled in steps 418 and 419 to move the gimbal unit and gantry unit back to the home position (0, 0, 0, 0, 0, 0).

Figure 17:
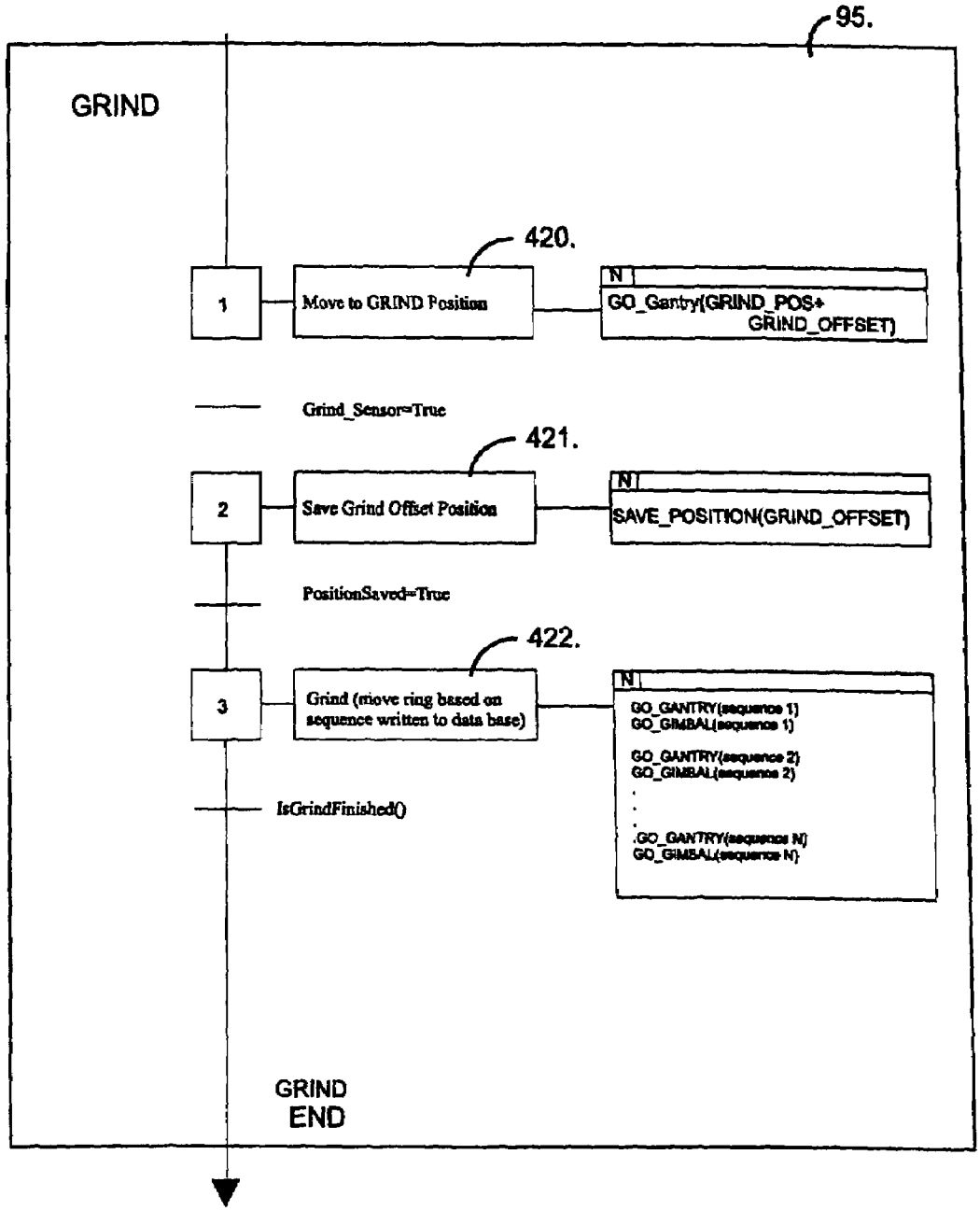
FIG. 17 is a software flow diagram of the GRIND procedure of FIG. 10.

FIG. 17 illustrates the GRIND procedure 95 of FIG. 10. In this procedure, the gantry motors are operated to move the gantry to a selected grind position with grind offset (420). The grind offset position is then saved (421), and the programmed grinding sequence is carried out (422), moving the ring to the successive grinding wheels.

Figure 18A:
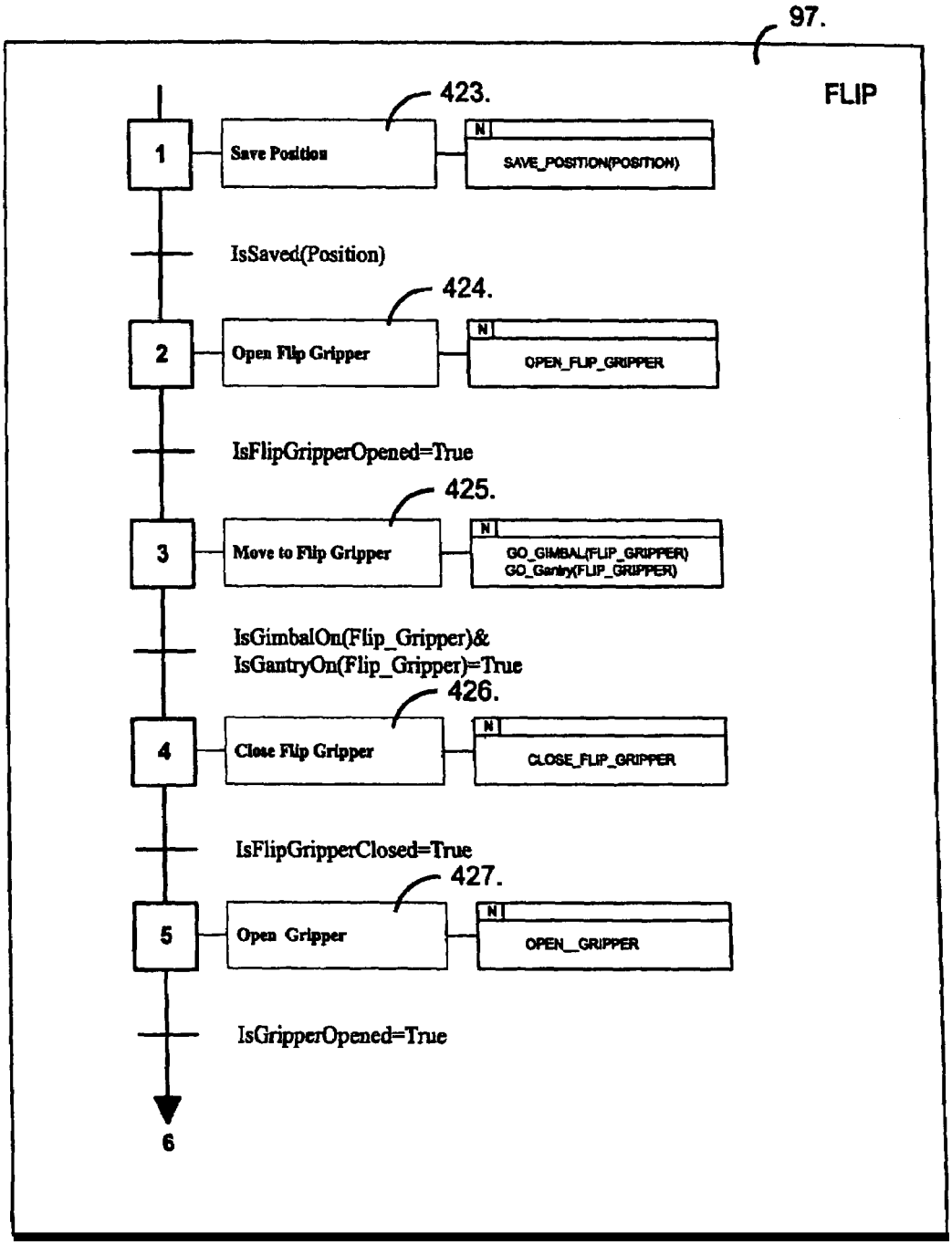
FIGS. 18*a* to 18*b* are software flow diagrams of the FLIP procedure of FIG. 10.
Figure 18B:
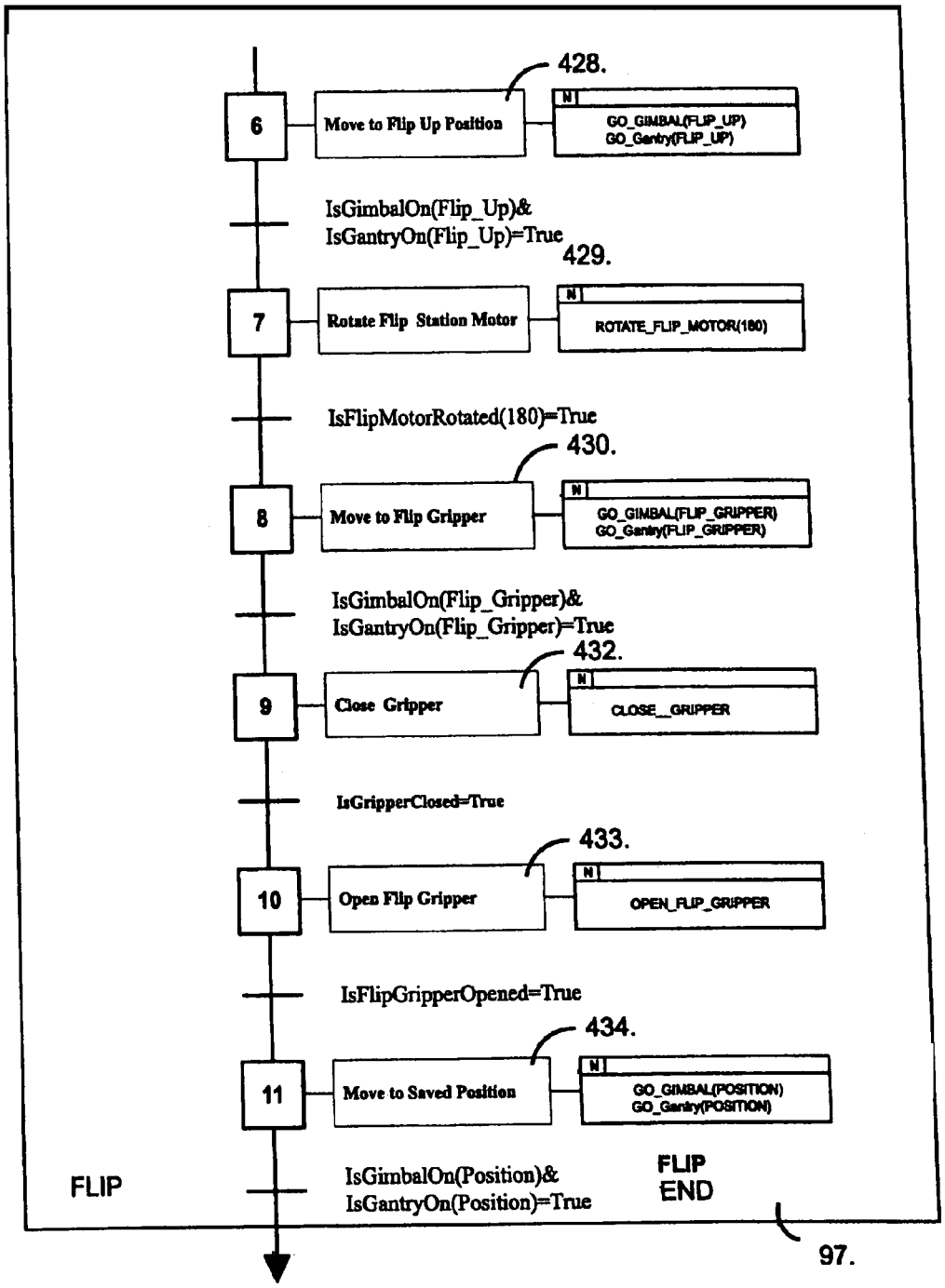

The FLIP procedure 97 of FIG. 10 is illustrated in FIGS. 18*a* and 18*b*. The flip procedure first saves the current piece orientation and position (423). The flip gripper is then opened (424), and the gantry and gimbal units are operated to move the gripper unit holding the ring to the flip gripper (425) and position the ring inside the open fingers of the flip gripper. The flip gripper is then closed (426), at which point the ring is gripped by the flip gripper as well as the hand gripper unit. The fingers of the hand gripper unit are then opened (427). The hand gripper unit is then moved up, out of the way of the flip gripper (428). The flip station motor is then rotated so as to rotate the ring through 180 degrees (429). The hand gripper unit is then moved back to the flip gripper (430), and the gripper fingers are closed to grip the ring with the ring in the flipped position (432). The flip gripper fingers are then opened to release the ring (433), and the gripper unit is moved back to the saved position (434). This completes the flip procedure.

Figure 19:
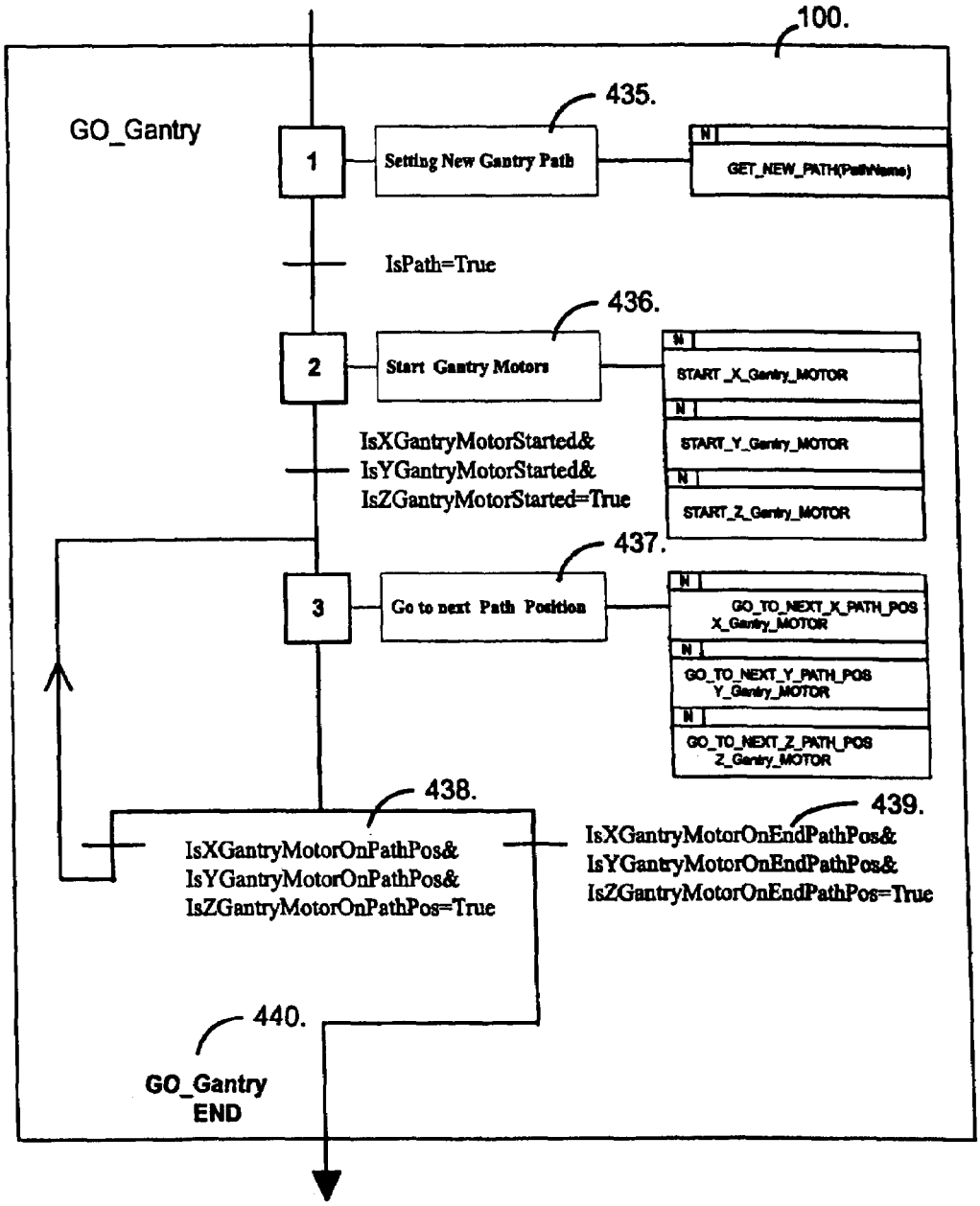
FIG. 19 is a software flow diagram of the gantry operating procedure of FIG. 10.

FIG. 19 illustrates the GO GANTRY procedure which controls the gantry motors to move along a predefined path. The new gantry path is first set and provided with a path name (435). The gantry motors are then started (436), and controlled to move the gimbal and gripper units to the first set path position (437). If there is another set path position (438), the system returns to step 436 to control the motors in order to move to the next path position. If the gantry motors are at the end path position (439), the GO GANTRY procedure is ended (440).

Figure 20:
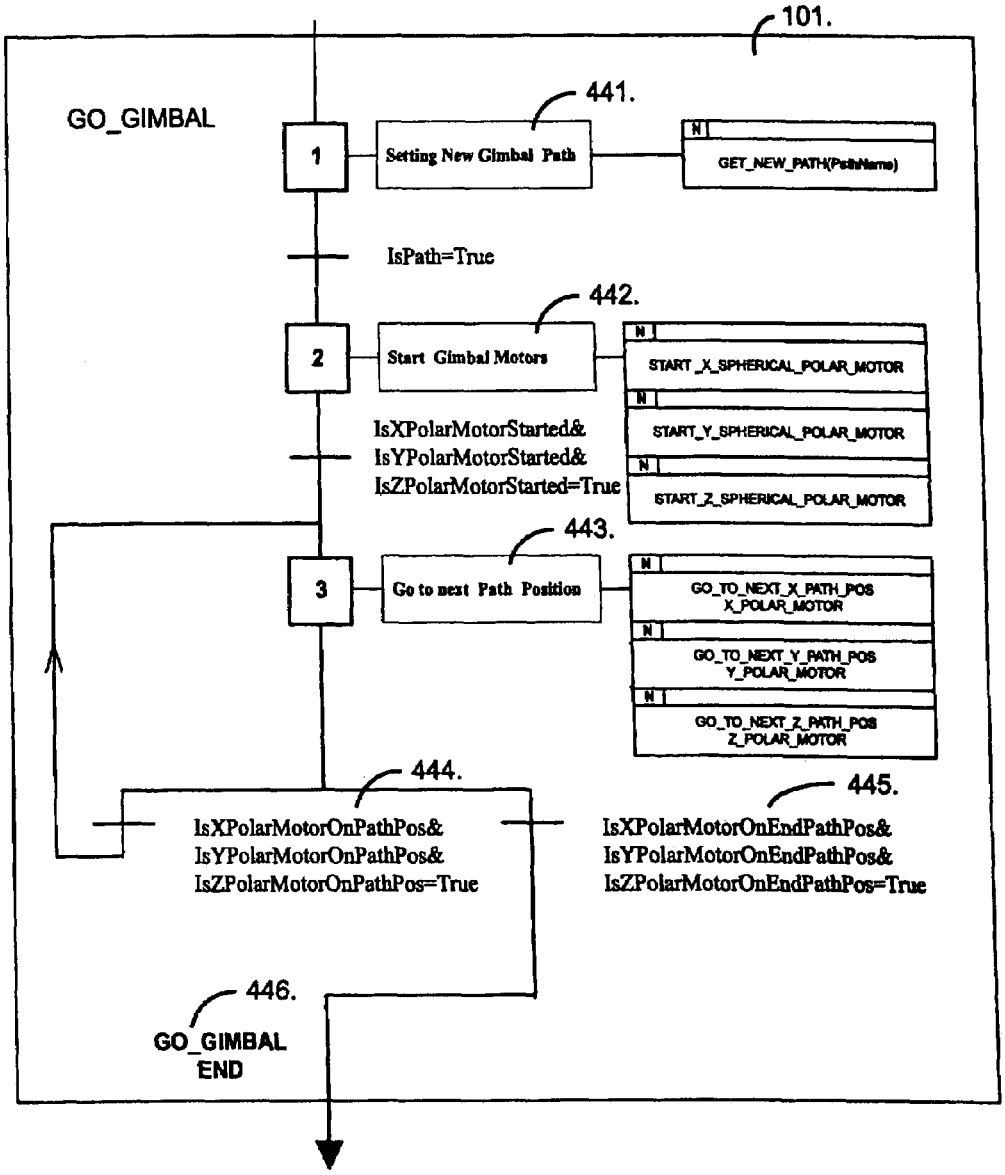
FIG. 20 is a software flow diagram of the gimbal operating procedure of FIG. 10.

FIG. 20 illustrates the GO GIMBAL procedure 101 of FIG. 10. In this procedure, a new gimbal path is first set and provided with a path name (441). The gimbal motors are then started (442), and controlled to move the hand gripper unit to a first set path position (443). If there are more path positions (444), the procedure returns to step 443 to operate the gimbal motors until the gripper unit reaches the next path position. If the path position is the end path position (445), the GO GIMBAL procedure is ended (446).

Figure 21:
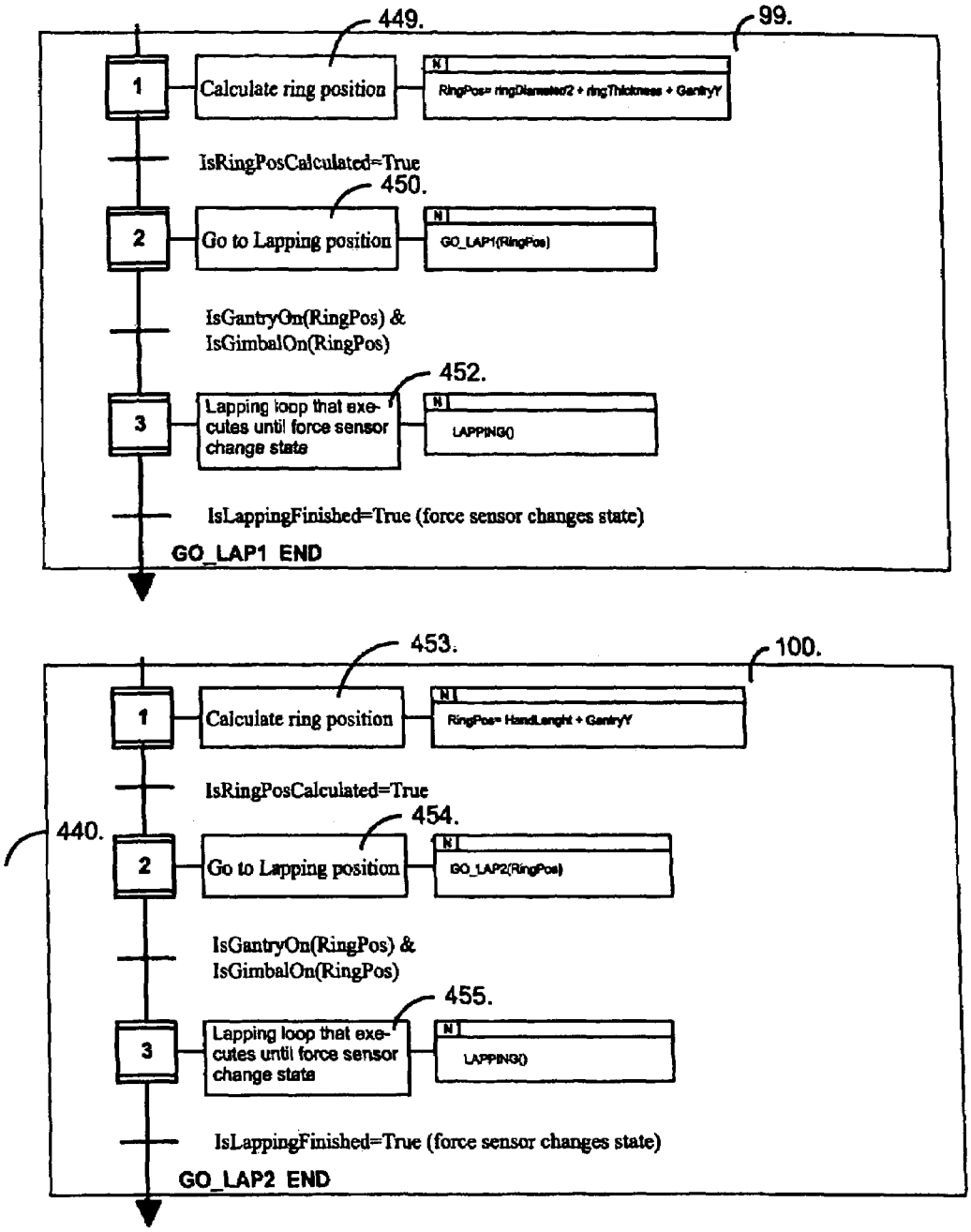
FIG. 21 is a software flow diagram of the two lapping procedures of FIG. 10.

FIG. 21 illustrates the GO LAP1 procedure 99 and the GO LAP2 procedure 100 of FIG. 10. There are two different lapping or sprue removal procedures. The first is when the sprue is on the inner or outer ring face, and the second is when the sprue is on the shank or outer side faces. In the first case (LAP1), the gripper unit fingers must be vertical to hold the ring horizontally. In the second case (LAP2), the gripper unit fingers must be horizontal to hold the ring vertically.

The force controller which controls sliding movement of the tool bed and thus grinding force has one zero position, detected by a sensor 128 (FIG. 2). When a ring moves a lapping wheel, the sensor sends a signal to the computer indicating that the wheel has been moved. The software registers this state. In the LAP1 procedure, the ring position is first calculated (448). This is the position where the ring would be if there was no sprue on it, and is based on the ring diameter and thickness and the gantry Y position of the center of the ring. The ring position is calculated from the following relationship (449):

Ring position=Ring Diameter/2+Ring Thickness+
Gantry Y position of ring center.

The gantry motors are then controlled to move the ring to the lapping position (450), i.e. the position calculated in step 449. If there is sprue on the ring, this will also move the lapping wheel as will be detected by the tool bed sensor. Grinding is carried out in a lapping loop 452 until the force sensor changes state, i.e. back to the zero state, indicating that any projecting sprue has been ground off and the lapping wheel has moved back to its original position.

Figure 22A:
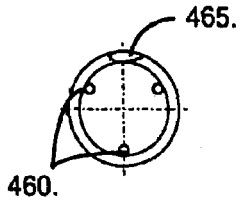
FIG. 22*a* is a front elevational view of the ring when held as in FIG. 22, illustrating the gripper finger layout for a lapping operation.
Figure 22:
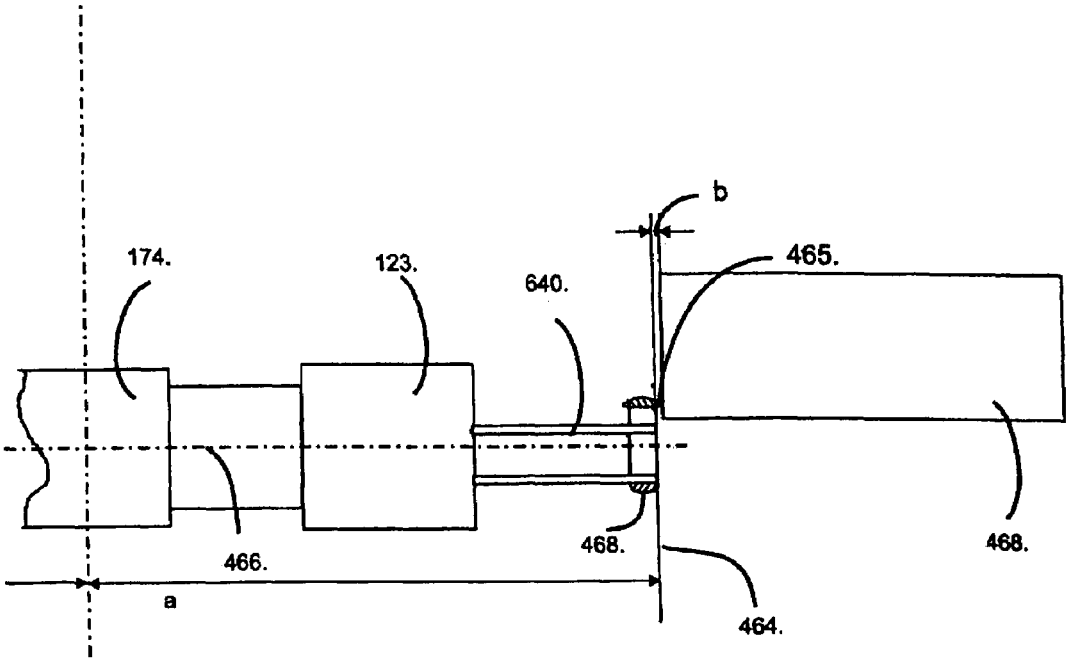
FIG. 22 is a schematic side elevational view illustrating a ring held by the main gripper unit against a lapping wheel in an orientation for lapping or sprue removal from the outer side face of the ring.

In the LAP2 procedure, the ring is held vertically and must be held as illustrated in FIGS. 22 and 22*a*. In other words, the main gripper unit fingers 460 must be positioned inside the vertically oriented ring 462 such that the outer ends of the fingers are aligned with the outer side face 464 of the ring. Additionally, the fingers must be positioned with the ring such that one finger is positioned opposite a sprue 465, as seen in FIGS. 22 and 22*a*. This may be done by the operator when originally positioning rings on the storage tray. Generally, the sprue will be centered at the bottom of the shank. Thus, when it is loaded (by the operator) the sprue always rests against the middle prong of the fixture or ring holder on the tray. From this position on, the ring is being handled in a consistent manner. This will ensure that the gripper fingers will be positioned as illustrated in FIG. 22*a* when the ring is picked up by the main gripper unit.

If the ring has multiple sprues on the outside then they are typically symmetric with respect to the center of the shank and the angle is known. If this is the case, then the system knows by how much it should turn from the center (original pick up position) to eliminate all sprues. In the case the sprues are not symmetric then again the position angle with respect to the center line of the shank needs to be known in order to control the gimbal unit to turn the ring appropriately during lapping. For the lapping operation LAP2, the gimbal unit z axis motor is parallel with the gantry y axis 466.

A no sprue ring position or zero position for the force controller or tool bed slider is calculated in step 453 (see FIG. 21). This is based on the overall length a of the gripper unit up to the ends of the fingers 460 and the gantry y position, i.e. the lapping wheel force controller zero position, in which the lapping wheel 468 is in a start or zero position, minus the hand overall length. The ring is then moved to the lapping position (454). Again, if there is sprue on the side face of the ring, the lapping wheel will be moved back by a length b equal to the sprue height, and this will be detected by the force controller sensor. A lapping loop is then executed (455) until the force sensor changes state, indicating that any projecting sprue has been removed and the ring is no longer pushing the lapping wheel, i.e. the lapping wheel has moved back to the zero position.

The software system and method of this invention for controlling jewelry processing will operate gantry and gimbal motors automatically under pre-set parameters and operation sequences to move a series of parts, such as rings, through a series of processing stations, and also operates tools at each processing station to process each ring in the same manner. The system is user friendly and easy to set up and operate. The system can be trained with different ring styles and sizes in the initial set up procedures. The system can also accommodate different ring styles and sizes within the same processing batch, simply by recording a ring style and size for each tray position. A user friendly graphical display in any selected one of three planes x-y, y-z or x-z is provided to enable the user to train the system using a specific piece that is to be subsequently ground and/or polished. Once one piece has been trained, the system will have stored software instructions for processing other identical pieces, improving consistency. Once trained on a series of ring styles and sizes, the controller can easily operate the machine automatically to move from tool to tool, repeat parts or whole operations, and provide for quality testing.

The software may also be provided with bar code capabilities. For example a bar code on a tray may indicate the ring styles and sizes on that tray, so that the program will know the size and style of the pieces to be processed. The software can automatically load motion programs associated with a specific part and may also load vision processes for the piece to be located by the gantry system on the fixture and/or monitored during the grinding or polishing process.

The motion control software is created on a modular principle, using separate subroutines that each perform a specific system function. Each function that makes up the motion software has specific parameters that are easily adjusted at the time the machine is manufactured. This approach allows easy transfer of configuration files from one machine to another. This software capability enables training of jewelry pieces to be done on a machine which is not necessarily the same one on which the pieces will be processed.

When the jewelry or piece processing machine is being manufactured or serviced, all motion parameters that are dependent on the particular machine parameters are calibrated and remain permanently stored. Geometry and grinding/polishing parameters that are associated with a specific jewelry piece are retained in the data base. Data defining a specific style and size and its grinding offsets can be added at any time.

The man machine interface provided in this system allows joystick based training of desired gantry paths and gimbal orientations, which will be relatively straightforward for the operator to carry out. The system is SCADA® based. The joy stick based trajectory planner is an integral part of this system. Unlike a robotic training system, this system is integral to a single computer or controller and does not require a separate device hooked to the tip of the gripper which is manually dragged through a desired path. Instead, this system is readily controlled during training by an operator via the user friendly, graphical operator interface 9, without having to touch any of the moving parts of the machine inside the housing. This makes the training process much safer, and the same training process can be carried out quickly and easily for each different part style.

Once training is complete, the system can be controlled to process a plurality of jewelry pieces automatically through a series of grinding and/or polishing operations. The machine configuration can be changed by the operator for a grinding or a polishing procedure. This allows jewelry processing steps which previously could only be carried out by hand to be added to an automatic processing sequence, reducing expense and time involved in jewelry manufacture and also improving product consistency.

The graphical interface of the system allows the user to structure the motion as well as to assign specific system commands. The graphical user interface may be used as a base for training of the system using 3D/CAD or scanned data.

The entire software system is based on an OPC client/server structure which allows various existing and independent protocols and/or software modules to be seamlessly interfaced with the system, added to the system, or subtracted from the system. This allows modification of the system to change hardware, drivers, or software modules for different applications. The OPC client/server structure allows standard software products to be added as a client to allow the user to monitor or modify any system parameter in real time through tools which are normally used for other applications.

The software can be easily adapted to work on a Windows CE® platform. It also allows portability from one processing machine to another so that a new training process does not have to be carried out for each new machine. Instead, the training procedures stored on a first machine can be transferred to the controller of other machines to perform equivalent style processing operations. The operator can monitor system parameters which will be automatically displayed on the screen throughout a production process, along with a running total of the average total precious metal consumption. A remote site diagnostic is possible through external monitoring of the system.

The processing control system and method of this invention can be readily adapted for controlling machines with gantry and gimbal devices for moving parts through any processing steps, and is not limited to jewelry processing. Other types of processing may be carried out by appropriate change in the hardware and the software processing steps. For example, the system could be adapted for other material removal applications, laser jet cutting, welding, assembly, palletizing, laser deposition, pick/p[lace and friction steer welding.

Although some exemplary embodiments of the invention have been described above by way of example only, it will be understood by those skilled in the field that modifications may be made to the disclosed embodiments without departing from the scope of the invention, which is defined by the appended claims.

I claim:

1. A processing control system for controlling processing of a series of workpieces, comprising:

a gantry unit having a frame and a horizontal work plate mounted on the frame, and a gantry system having x, y and z translational directions of freedom, each direction of freedom having an associated sliding carriage and drive motor;

a gimbal unit mounted on the gantry system above the work plate and having x, y and z rotational degrees of freedom and associated x, y and z gimbal motors for controlling rotation about the x, y and z rotational axes of the gimbal unit;

a gripper unit secured to the gimbal unit for holding a workpiece to be processed and an actuator for actuating the gripper unit to grip and release a workpiece;

a plurality of processing stations mounted on the work plate, each processing station having at least one associated actuator for controlling operation of one or more tools at the processing station;

a controller linked to the gantry and gimbal unit motors, the gripper unit actuator, and the processing station actuators for controlling movement of the gripper unit from a start position to pick up a workpiece and move it along a programmed path between the processing stations, and for controlling operation of actuators at each processing station to process workpieces according to stored program instructions including grinding force parameters;

at least one user input device linked to said controller for selective manual control of said gantry and gimbal unit motors, gripper unit actuator, and processing station actuators; and an output monitor for displaying machine and operating parameters to a user.

2. The system as claimed in claim 1, wherein said user input device comprises a joystick movable in left and right and up and down directions, and having two additional movement control buttons.

3. The system as claimed in claim 2, wherein said controller has gantry operating means for manual operation of the gantry unit comprising means for associating right and left movements of the joystick input device with operation of the gantry x-axis motor to move a gantry x-axis carriage in corresponding directions, means for associating up and down movements of the joystick input device with operation of the gantry y-axis motor to move a gantry y axis carriage in opposite directions, and means for associating actuation of respective buttons on the joystick with operation of the gantry z-axis motor to move a gantry z-axis carriage in opposite directions, and gimbal operating means comprising means for associating right and left movements of the joystick with operation of a first gimbal motor to rotate in opposite directions, means for associating up and down movements of the joystick with operation of a second gimbal motor to rotate in opposite directions, and means for associating actuation of respective buttons on the joystick with operation of a third gimbal motor to rotate in opposite directions.

4. The system as claimed in claim 3, wherein said controller has a training mode further comprising means for user entry of data points as the gantry and gimbal units are controlled to move the gripper unit along a selected trajectory from a home position to a workpiece storage tray and from the tray past a series of selected processing stations whereby the user can train the controller with a selected trajectory for a particular style of workpiece.

5. The system as claimed in claim 4, wherein the training mode further comprises means for user entry of commands for actuating processing tools at the processing stations on the selected trajectory.

6. The system as claimed in claim 4, wherein the controller further comprises means for storing a series of workpiece processing sequences, each sequence being associated with a selected workpiece style and based on training commands entered by a user during training modes for each workpiece style.

7. The system as claimed in claim 1, wherein said controller further comprises tray set up means for user entry of the style and size of each workpiece to be processed in an automated processing operation and the position of each workpiece on a storage tray.

8. The system as claimed in claim 7, wherein the tray set up means further comprises means for copying a style and size previously entered to additional positions on the storage tray.

9. The system as claimed in claim 7, wherein the tray set up means further comprises means for entering an empty designation for a tray location carrying no workpiece.

10. The system as claimed in claim 7, wherein the controller further comprises means for automatically processing a series of workpieces on a tray based on a sequence of stored travel path and processing instructions associated with each style of workpiece on the tray, the automatic processing means comprising means for controlling the gantry and gimbal units to move the gripper unit from a start position to a location above a first position on the storage tray, means for lowering the gripper unit and actuating the gripper unit to pick up the workpiece at the first position, means for controlling the gantry and gimbal units and the processing station tools to process the workpiece according to the stored program instructions for the style and size of workpiece entered, means for returning the processed workpiece to the original tray or a separate tray, and means for repeating the automatic processing procedure until each workpiece on the storage tray has been processed according to the stored program instructions for the style and size of that particular workpiece.

11. The system as claimed in claim 10, wherein the controller further comprises means for stopping the automatic processing sequence in the event of an error.

12. The system as claimed in claim 11, including an alarm which is actuated by the controller on detection of an error.

13. The system as claimed in claim 1, wherein the workpieces comprise pieces of jewelry and at least one work station has a grinding tool.

14. The system as claimed in claim 13, wherein the jewelry pieces are rings and at least one work station includes a lapping tool for removing sprues from the outer and inner faces of the ring and from the outer side faces of the ring, and the controller further comprises means for controlling the gantry and gimbal units and the lapping tool to carry out a first lapping operation in which the ring is held horizontally and sprue is removed from the outer and inner surfaces of the ring and a second lapping operation in which sprue is removed from the outer side faces of the ring.

15. The system as claimed in claim 14, wherein the work stations include a flip station having a flip gripper for changing the orientation of a ring held by the gripper unit, the controller further comprising means for controlling the gripper unit to hold the ring vertically during the second lapping operation to expose a first side face of the ring for lapping against the lapping tool, means for controlling the lapping tool to remove sprue from the first side face of the ring, means for controlling the gantry and gimbal units to move the gripper unit to the flip station when lapping of the first side face is complete, means for controlling the flip gripper to hold the ring and flip the ring through 180 degrees, means for controlling the gripper unit to grip the flipped ring from the opposite side after it has been flipped such that the opposite, second side face of the ring is exposed for lapping, means for controlling the gantry and gimbal units to move the ring back to the lapping tool after flipping, and means for controlling the lapping tool to remove sprue from the second side face of the ring.

16. The system as claimed in claim 1, wherein the controller further comprises a graphical user interface for display of current system working parameters on the output monitor, the working parameters including a graphical display of the current position of the gantry and gimbal units in any one of three graphical planes, the planes comprising x-y, y-z, and x-z planes.

17. The system as claimed in claim 16, wherein the parameters include the style and size of the workpiece currently being processed and the original position of the workpiece on a storage tray prior to processing.

18. The system as claimed in claim 17, wherein the processing stations comprise tools for controlled removal of material from a workpiece in order to shape the workpiece, the controller further comprising means for continuously calculating the average total material removal in a processing sequence and for displaying the average total material removed as a current working parameter on the output monitor.

* * * * *